US010683164B1

(12) United States Patent
Williamson, Jr. et al.

(10) Patent No.: US 10,683,164 B1
(45) Date of Patent: Jun. 16, 2020

(54) LAWN WASTE BAG SUPPORT DEVICES

(71) Applicants: David C. Williamson, Jr., Magnolia, AR (US); James Dickens Davis, Minden, LA (US)

(72) Inventors: David C. Williamson, Jr., Magnolia, AR (US); James Dickens Davis, Minden, LA (US)

( * ) Notice: Subject to any disclaimer, the term of this patent is extended or adjusted under 35 U.S.C. 154(b) by 0 days.

(21) Appl. No.: 16/520,495

(22) Filed: Jul. 24, 2019

(51) Int. Cl.

| | |
|---|---|
| ***B65D 1/00*** | (2006.01) |
| ***B65D 33/00*** | (2006.01) |
| ***B65F 1/14*** | (2006.01) |
| ***B65F 1/10*** | (2006.01) |
| ***B65F 1/00*** | (2006.01) |

(52) U.S. Cl.
CPC ..... *B65F 1/141* (2013.01); *B65F 1/0006* (2013.01); *B65F 1/10* (2013.01); *B65D 33/007* (2013.01); *B65F 1/002* (2013.01); *B65F 2240/138* (2013.01)

(58) Field of Classification Search
USPC ..... 248/95, 99, 101; 220/908.3, 9.4; 383/33–34.1
See application file for complete search history.

(56) References Cited

U.S. PATENT DOCUMENTS 4,488,697 A * 12/1984 Garvey ..... B65F 1/1415 248/101
4,629,233 A 12/1986 Pfisterer
4,832,291 A 5/1989 Nelson et al.
4,899,967 A * 2/1990 Johnson ..... B65B 67/12 248/97
5,031,277 A 7/1991 Coker
5,107,666 A 4/1992 Rahtican
5,149,028 A 9/1992 Blackaby et al.
5,498,046 A 3/1996 Ridley, Sr. et al.
5,593,117 A 1/1997 Alexander, III
5,836,553 A * 11/1998 Bergaila ..... B65B 67/1233 248/99
6,708,742 B2 3/2004 Weathers et al.
7,975,732 B2 7/2011 Schoniger
9,926,133 B1 3/2018 Alrumaih
2003/0173471 A1 9/2003 Weathers et al.
2004/0184679 A1* 9/2004 Williamson ..... B65D 88/1612 383/38
2006/0226302 A1* 10/2006 Kuo ..... B65B 67/1235 248/95
2009/0230258 A1* 9/2009 McFadden ..... B65B 67/1233 248/101
2010/0140423 A1* 6/2010 Davies ..... B65D 1/1415 248/101
2010/0200709 A1* 8/2010 Wilkinson ..... B65B 67/1238 248/99
2011/0309210 A1 12/2011 Muse
2013/0320159 A1 12/2013 Clark

* cited by examiner

*Primary Examiner* — Alfred J Wujciak
(74) *Attorney, Agent, or Firm* — R. Keith Harrison

(57) ABSTRACT

Lawn waste bag support devices for holding a lawn waste bag in an open position may include a device frame. A bag ring support frame may be carried by the device frame. The bag ring support frame may have at least one ring channel. A bag ring may be configured to receive and hold the lawn waste bag in an open position. The bag ring removably may be deployable in at least one ring channel.

20 Claims, 24 Drawing Sheets

LAWN WASTE BAG SUPPORT DEVICES

FIELD

Illustrative embodiments of the disclosure are generally directed to devices for gathering and disposing of lawn waste. More particularly, illustrative embodiments of the disclosure are directed to lawn waste bag support devices which support a lawn waste bag in an open position for ease in gathering lawn waste into the bag.

SUMMARY

Illustrative embodiments of the disclosure are generally directed to lawn waste bag support devices which support a lawn waste bag in an open position for ease in gathering lawn waste into the bag. An illustrative embodiment of the lawn waste bag support devices may include a device frame. A bag ring support frame may be carried by the device frame. The bag ring support frame may have at least one ring channel. A bag ring may be configured to receive and hold the lawn waste bag in an open position. The bag ring may be removably deployable in at least one ring channel.

BRIEF DESCRIPTION OF THE DRAWINGS

Illustrative embodiments of the disclosure will now be described, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable users skilled in the art to practice the disclosure and are not intended to limit the scope of the claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description.

Figure 17:
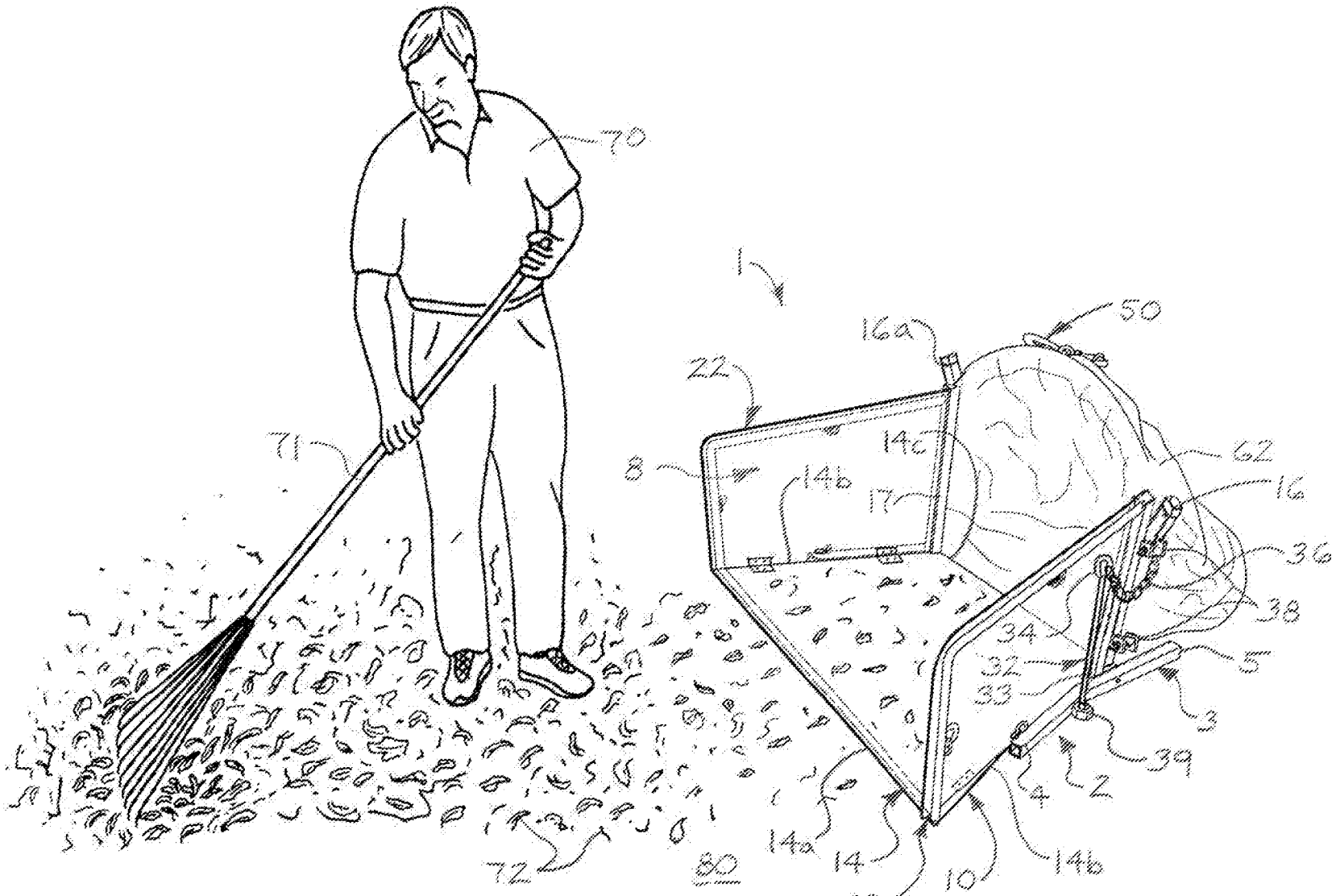
FIG. 17 is a front perspective view of the illustrative lawn waste bag support device deployed in the functional configuration on a lawn in typical application of the device.

Referring initially to FIG. 17 of the drawings, an illustrative embodiment of the lawn waste bag support devices, hereinafter device, of the disclosure is generally indicated by reference numeral 1. In typical application, which will be hereinafter described, the device 1 may be deployed on a lawn 80 to support a lawn waste bag 62 in an open position. Accordingly, a user 70 can use a rake or other yard implement 71 to rake and/or otherwise displace leaves, pine straw, trash and/or other lawn waste 72 from the lawn 80 into the lawn waste bag 62. When it is full, the lawn waste bag 62 can be detached from the device 1, tied closed and discarded. A replacement lawn waste bag 62 may subsequently be attached to the device 1 as deemed necessary for continued removal of the lawn waste 72 from the lawn 80 into the lawn waste bag 62. In some embodiments, the device 1 may be capable of being deployed from an extended, functional configuration illustrated in FIG. 17 to a folded or collapsed, non-functional configuration, typically as will be hereinafter described, to facilitate space-efficient transport and/or storage of the device 1. The device 1 may be adaptable to lawn waste bags 62 having various diameters, thicknesses and materials.

Referring next to FIGS. 1-19 of the drawings, the device 1 may include a device frame 2. A base panel 14 may be supported by the device frame 2. A pair of spaced-apart side panel assemblies 22 may extend upwardly from the base panel 14. A device interior 8 may be formed by and between the base panel 14 and the side panel assemblies 22.

The bag ring support frame 9 may have at least one ring channel 56, 58. In some embodiments, the ring channel may include a bottom ring channel 56 which may be formed by and between the device frame 2 and the base panel 14 and a pair of spaced-apart side ring channels 58 formed by and between the device frame 2 and the respective side panel assemblies 22. The side ring channels 58 may communicate with the bottom ring channel 56. In some embodiments, the bottom ring channel 56 and the side ring channels 58 may be adjustable in width typically in a manner which will be hereinafter described.

A bag ring 42 may be removably inserted in the bottom ring channel 56 and the side ring channels 58. The lawn waste bag 62 (FIG. 17) may be attachable to the bag ring 42 typically in a manner which will be hereinafter described, after which the bag ring 42 may be inserted in the side ring channels 58 and the bottom ring channel 56. Accordingly, the bag ring 42 may hold the lawn waste bag 62 in an open position and in communication with the device interior 8 to facilitate placement of the lawn waste 72 from the lawn 80 (FIG. 17) into the lawn waste bag 62 through the device interior 8.

In some embodiments, the device frame 2 may include a pair of elongated, spaced-apart side frame members 3. Each side frame member 3 may have a front frame member segment 4 and a rear frame member segment 5. The rear frame member segments 5 of the side frame members 3 may be parallel to each other. The front frame member segments 4 may extend outwardly at an obtuse angle from the rear frame member segment 5 at a frame bend 6. In some embodiments, the side frame members 3 and other members and components of the device frame 2 may be square tubing.

The device frame 2 may further include a base frame portion 10 which extends from the front frame member segments 4 of the respective side frame members 3. In some embodiments, the base frame portion 10 may include a pair of elongated side base members 11 which may extend forwardly from the respective front frame member segments 4. The side base members 11 of the base frame portion 10 may be disposed at the same angle with respect to the rear frame member segments 5 as the front frame member segments 4. A front base member 12 and a rear base member 13 may extend between the side base members 11 typically in parallel, spaced-apart relationship to each other. The base panel 14 may be supported by the side base members 11, the front base member 12 and the rear base member 13 of the base frame portion 10.

Figure 16:
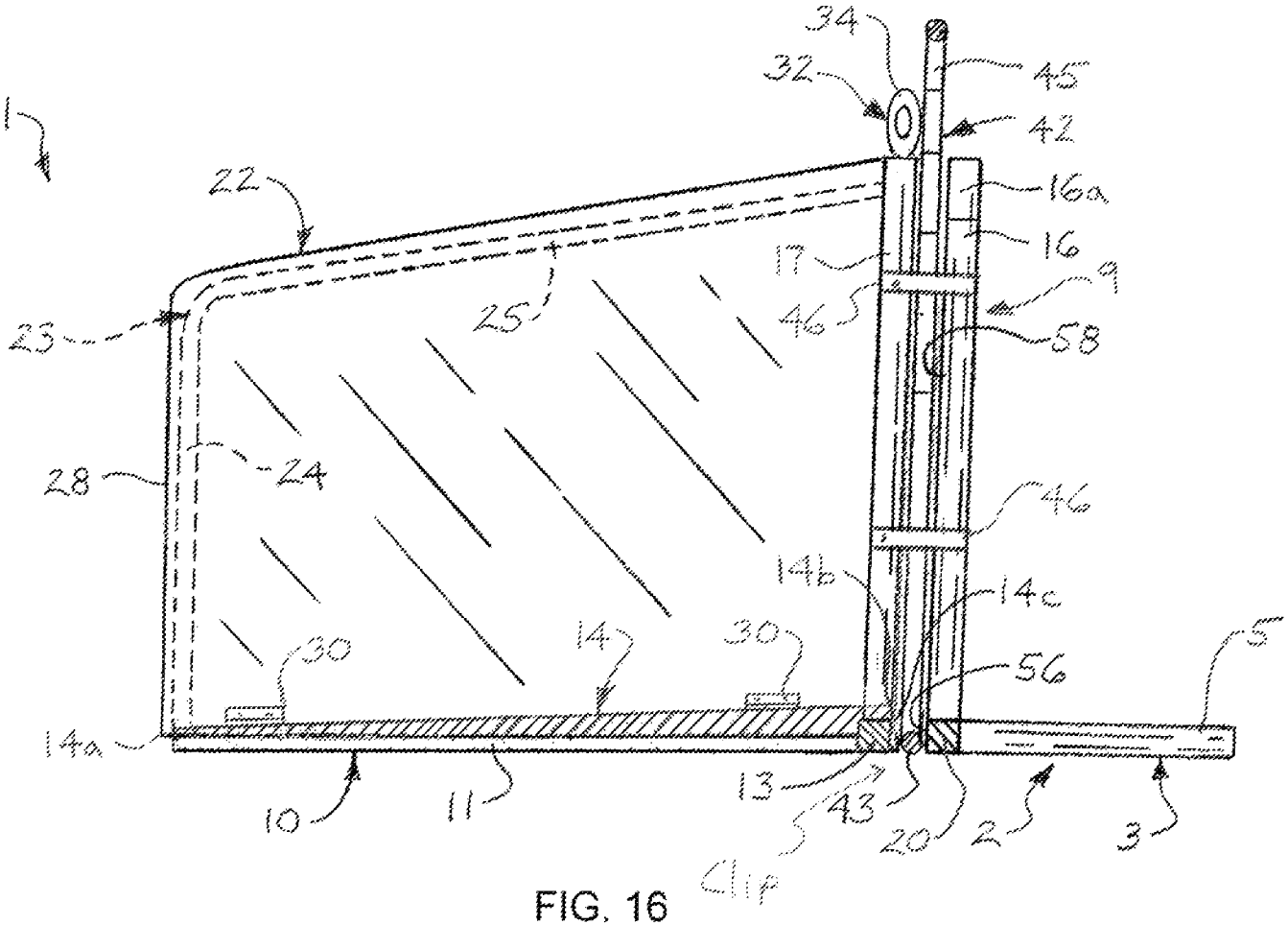
FIG. 16 is a sectional view, taken along section lines 16-16 in FIG. 14, of the illustrative lawn waste bag support device.

In some embodiments, the base panel 14 may have a wide panel edge 14*a*. A narrow panel edge 14*b* may extend in spaced-apart and parallel relationship to the wide panel edge 14*a*. A pair of side panel edges 14*c* may extend toward each other from the wide panel edge 14*a* to the narrow panel edge 14*b*. Accordingly, the side panel assemblies 22 may extend along the respective side panel edges 14*c* from the wide panel edge 14*a* to the narrow panel edge 14*b* of the base panel 14 for purposes which will be hereinafter described. As illustrated in FIG. 16, in some embodiments, the base panel 14 may slope or ramp upwardly from the wide panel edge 14*a* to the narrow panel edge 14*b*. The narrow panel edge 14*b* may terminate at or along the upper surface of the rear base member 13. In some embodiments, a non-slip material (not illustrated) may be provided on the bottom surface of the device frame 2 and/or base panel 14 to prevent inadvertent sliding or slippage of the device 1 during use. The non-slip material may include at least one pad, coating and/or other material or structure which has a coefficient of friction sufficient for the purpose. As illustrated in FIG. 16, in some embodiments, the base panel 14 may have a sloped configuration.

The device frame 2 may further include a bag ring support frame 9 having a pair of spaced-apart front ring retaining members 16. The front ring retaining members 16 may extend upwardly from the respective rear frame member segments 5 on the respective side frame members 3 of the device frame 2. A cross member 20 may extend between the front ring retaining members 16. A pair of front ring retaining members 17 may extend from the respective side frame members 3 of the device frame 2 typically at respective ends of the rear base member 13 of the base frame portion 10. The front ring retaining members 17 may be disposed in front of and in parallel, spaced-apart relationship with respect to the respective rear ring retaining members 16. Accordingly, the bottom ring channel 56 may be formed by and between the rear base member 13 and the cross member 20 of the device frame 2. The side ring channels 58 may be formed by and between the rear ring retaining members 16 and the respective front ring retaining members 17. In some embodiments, each rear ring retaining member 16 and/or each front ring retaining member 17 may have an outwardly angled terminal portion 16*a* for purposes which will be hereinafter described. In some embodiments, at least one ring clip 46 may extend between each front ring retaining member 16 and corresponding rear ring retaining member 17 to retain the bag ring 42 in the bottom ring channel 56 and the side ring channels 58.

In some embodiments, each side panel assembly 22 may include a panel frame 23. A side panel 28 may be supported by the panel frame 23. Each panel frame 23 may include a front panel frame segment 24. A top panel frame segment 25 may extend rearwardly from the front panel frame segment 24. Accordingly, each side panel 28 may be supported by and extend between the front panel frame segment 24 and the top panel frame segment 25 of the panel frame 23 of each corresponding side panel assembly 22. Each side panel 28 may be attached to the corresponding panel frame 23 using mechanical fasteners and/or any other suitable technique known by those skilled in the art. In some embodiments, each side panel assembly 22 may include the side panel 28 without the panel frame 23.

In some embodiments, each side panel assembly 22 may be pivotally attached to the base panel 14 or the corresponding side base member 11 of the base frame portion 10 according to the knowledge of those skilled in the art. Accordingly, in some embodiments, at least one panel hinge 30 may pivotally attach the side panel 28 of each side panel assembly 22 to the corresponding side panel edge 14*c* of the base panel 14 or side base member 11. Each side panel assembly 22 may thus be selectively deployable between the extended, functional configuration illustrated in FIGS. 1-7, 12 and 14 and the folded, non-functional configuration illustrated in FIGS. 11, 13 and 15. In some embodiments, each panel hinge 30 may be fitted with a releasable hinge locking mechanism (not illustrated) according to the knowledge of those skilled in the art to lock each side panel assembly 22 in the extended, functional position. Each panel hinge 30 can be selectively released to facilitate pivoting or folding of the corresponding side panel assembly 22.

In some embodiments, the side panel 28 of each side panel assembly 22 may be selectively attachable or securable to the corresponding front ring retaining member 17 to support the side panel assembly 22 in the upright position. For example and without limitation, in some embodiments, a panel groove (not illustrated) may be provided in the front surface of each front ring retaining member 17. The rear edge of each side panel 28 may be inserted into the panel groove to secure or stabilize the side panel 28 in the upright position. In other embodiments, each side panel 28 may be detachably secured to the corresponding front ring retaining member 17 using magnets, clamps and/or other suitable technique known by those skilled in the art.

In some embodiments, each front ring retaining member 17 may be pivotally mounted with respect to the rear frame member segment 5 of each corresponding side frame member 3 typically via a suitable retaining member hinge 18. Accordingly, as illustrated in FIGS. 9-11, 13 and 15, each front ring retaining member 17 may be selectively pivoted from the extended, functional configuration to the folded, non-functional configuration to lie on each corresponding side panel assembly 22 to facilitate space-efficient transport and/or storage of the device 1. In some embodiments, each retaining member hinge 18 may be fitted with a releasable hinge locking mechanism (not illustrated) according to the knowledge of those skilled in the art to lock the front ring retaining members 16 in the extended, functional position. The retaining member hinge 18 can be selectively released to facilitate pivoting or folding of the rear ring retaining member 16. Each retaining member hinge 18 may have any design which is known by those skilled in the art and suitable for the purpose.

Figure 19:
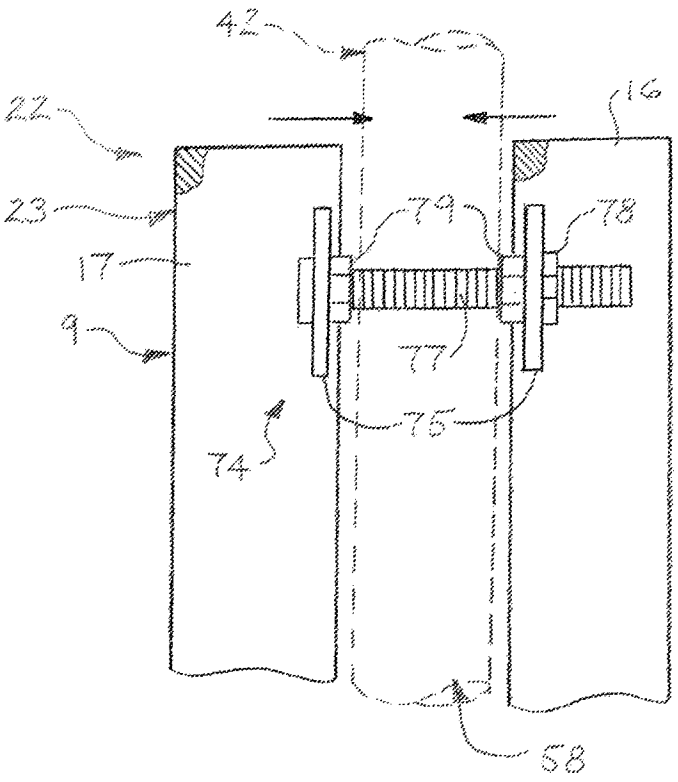
FIG. 19 is a front view of the channel adjustment assembly illustrated in FIG. 18.
Figure 18:
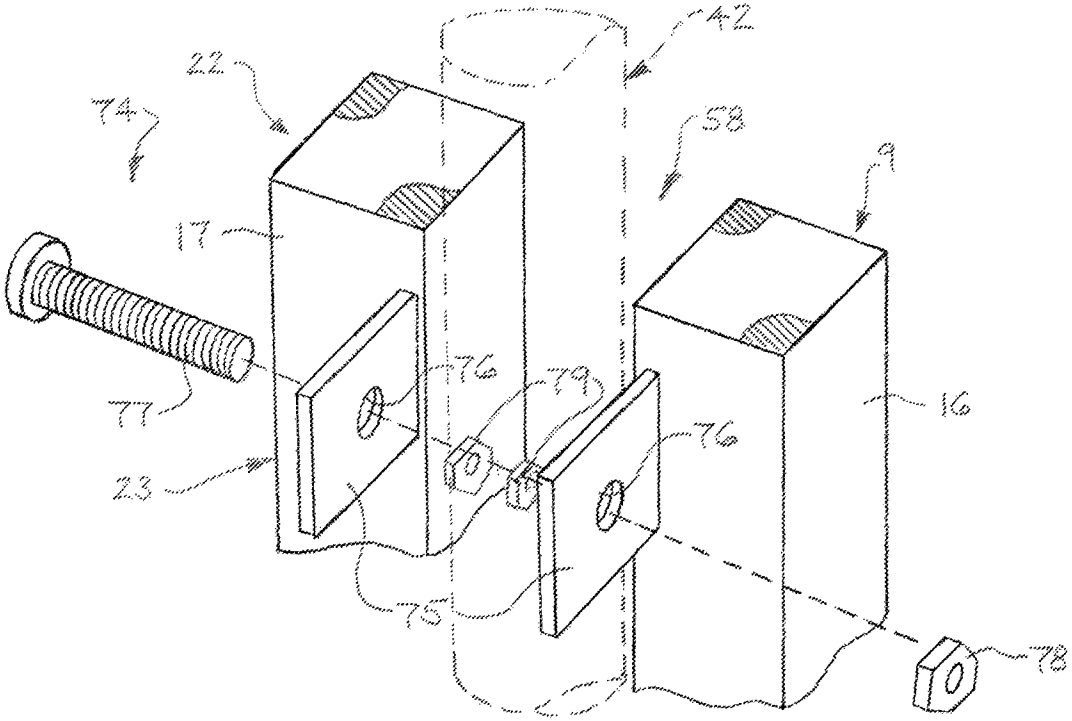
FIG. 18 is a perspective view of a typical channel adjustment assembly suitable for selectively adjusting the width of the side ring channels according to some illustrative embodiments of the lawn waste bag support devices.

As illustrated in FIGS. 18 and 19, in some embodiments, at least one channel adjusting assembly 74 may facilitate selective narrowing of each side ring channel 58 to secure the bag ring 42 in the side ring channels 58. Accordingly, at least one pair of spaced-apart channel adjustment flanges 75 may be welded and/or otherwise attached to each respective rear ring retaining member 16 and front ring retainer member 17 on each corresponding side of the device frame 2. Aligned bolt openings 76 may extend through the respective channel adjustment flanges 75. An adjustment bolt 77 may be extended through the bolt openings 76 in the respective channel adjustment flanges 75. A securing nut 78 may be threaded on the adjustment bolt 77. Jam nuts 79 may be threaded on the adjustment bolt 77 between the channel adjusting flanges 75. By threading the securing nut 78 on the adjustment bolt 77 against the corresponding channel adjusting flange 75, the width of the corresponding side ring channel 58 may be selectively reduced to adjust the fit of the bag ring 42 in the side ring channel 58.

Figure 1:
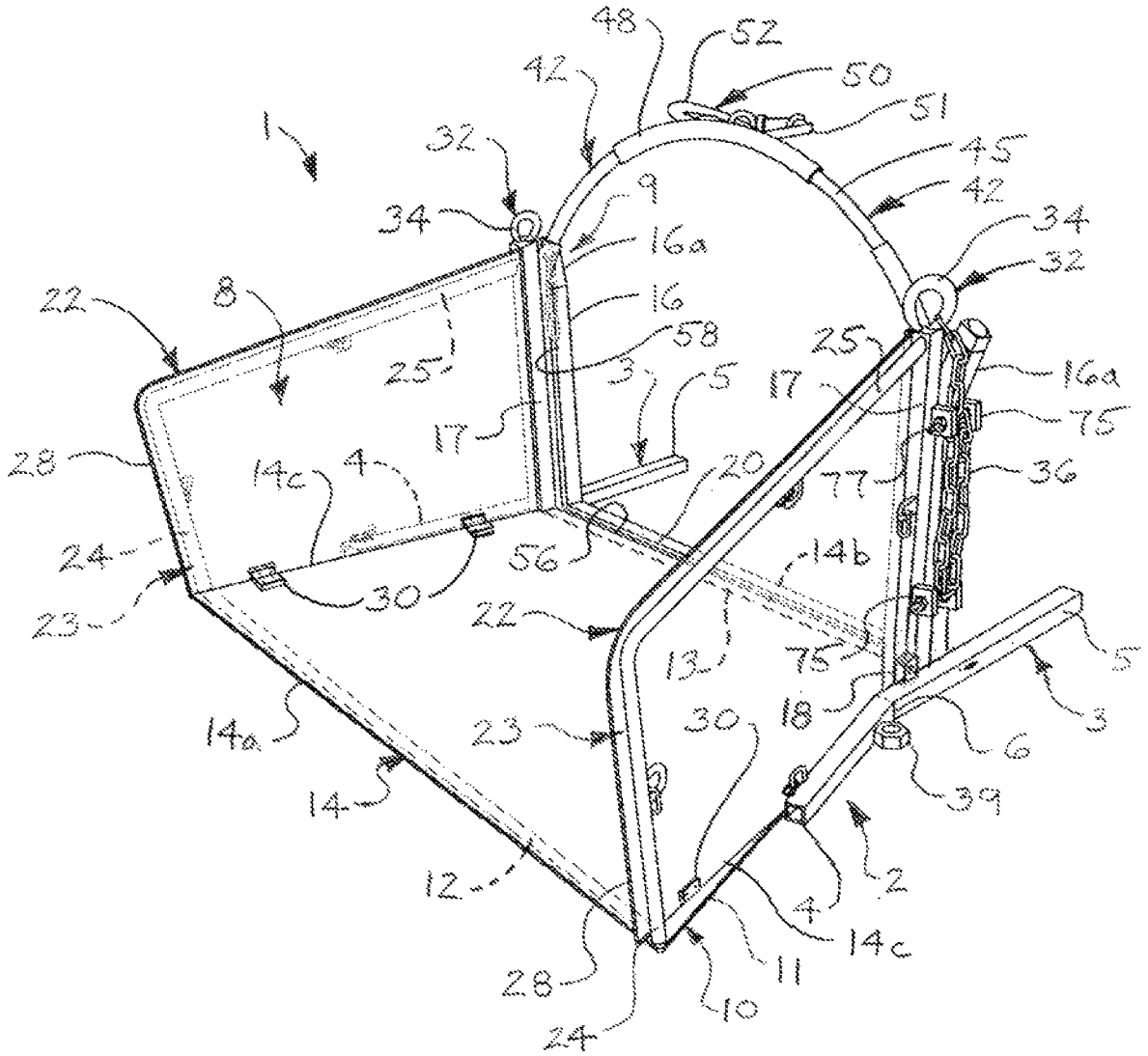
FIG. 1 is a front perspective view of an illustrative embodiment of the lawn waste bag support devices.
Figure 2:
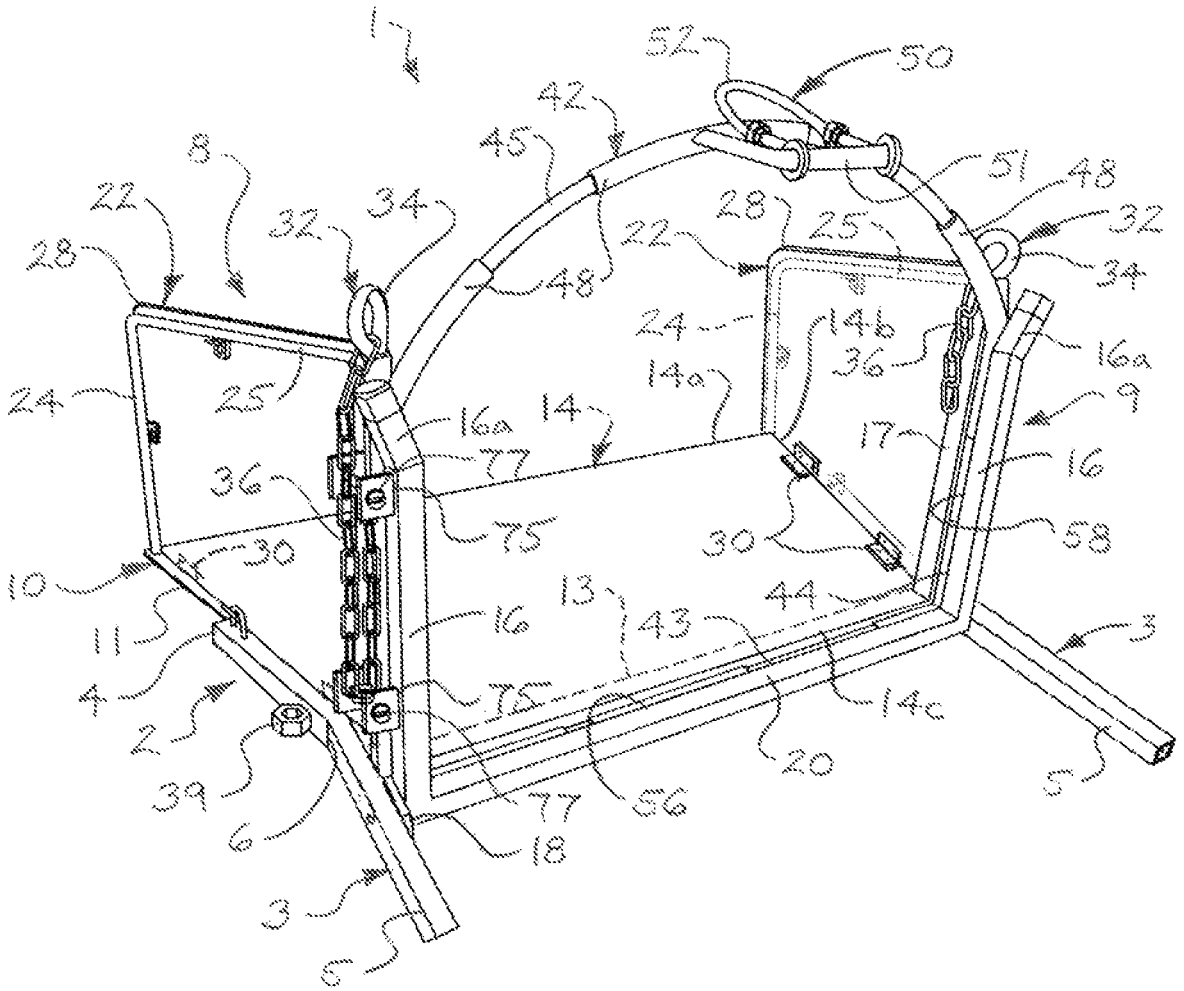
FIG. 2 is a rear perspective view of the illustrative lawn waste bag support device.
Figure 3:
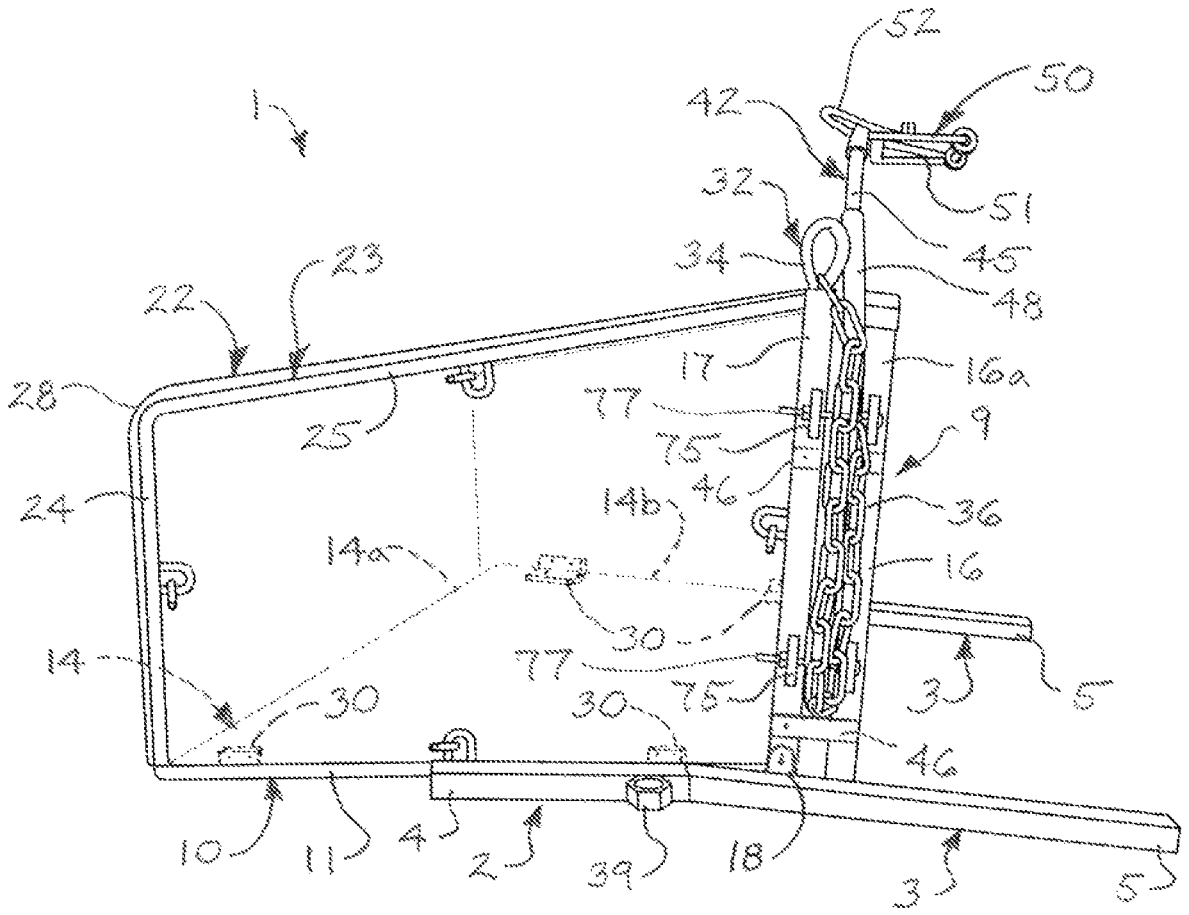
FIG. 3 is a left side view of the illustrative lawn waste bag support device.
Figure 4:
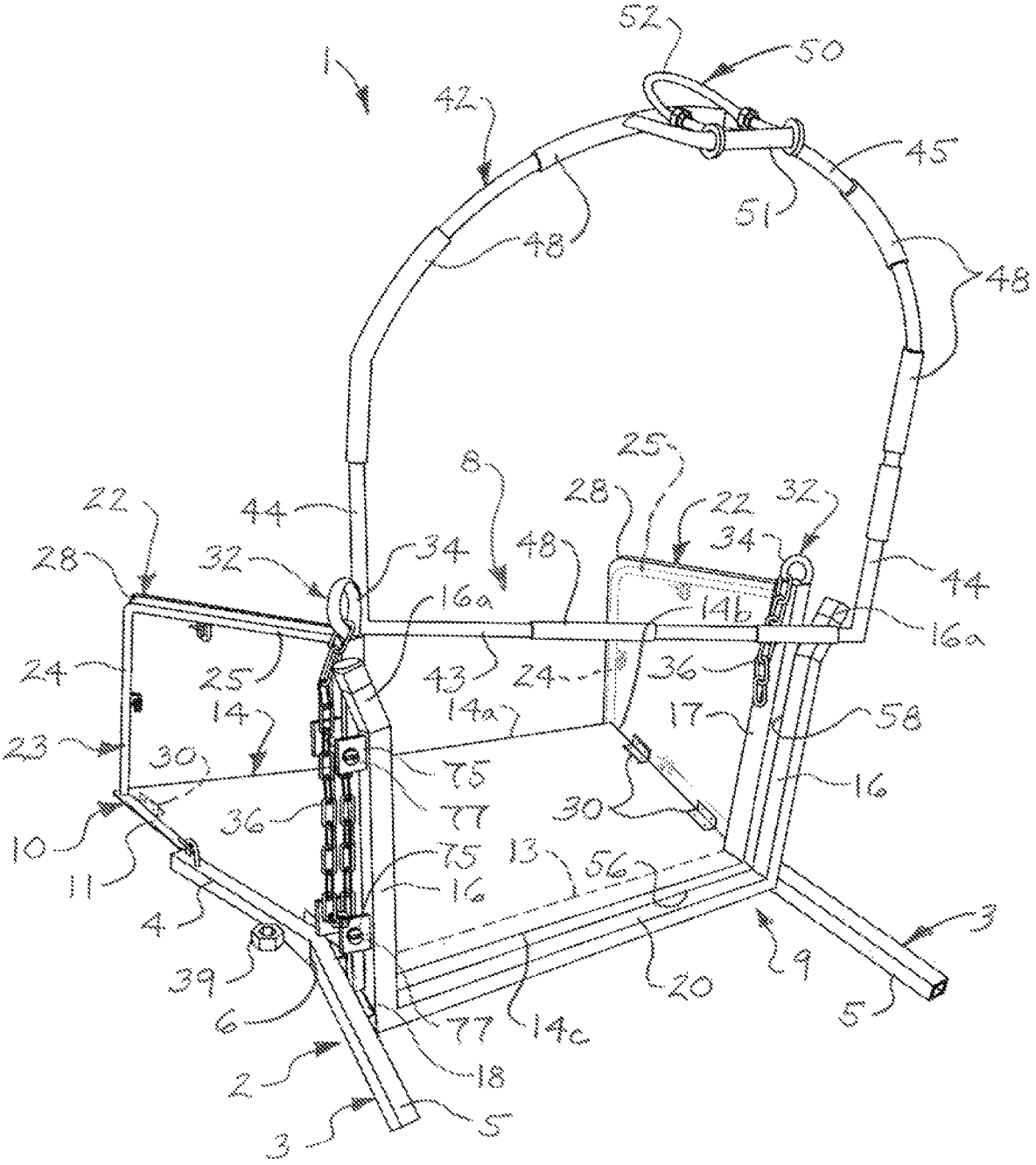
FIG. 4 is an exploded rear perspective view of the illustrative lawn waste bag support device, with the bag ring partially removed from the device frame of the device.
Figure 5:
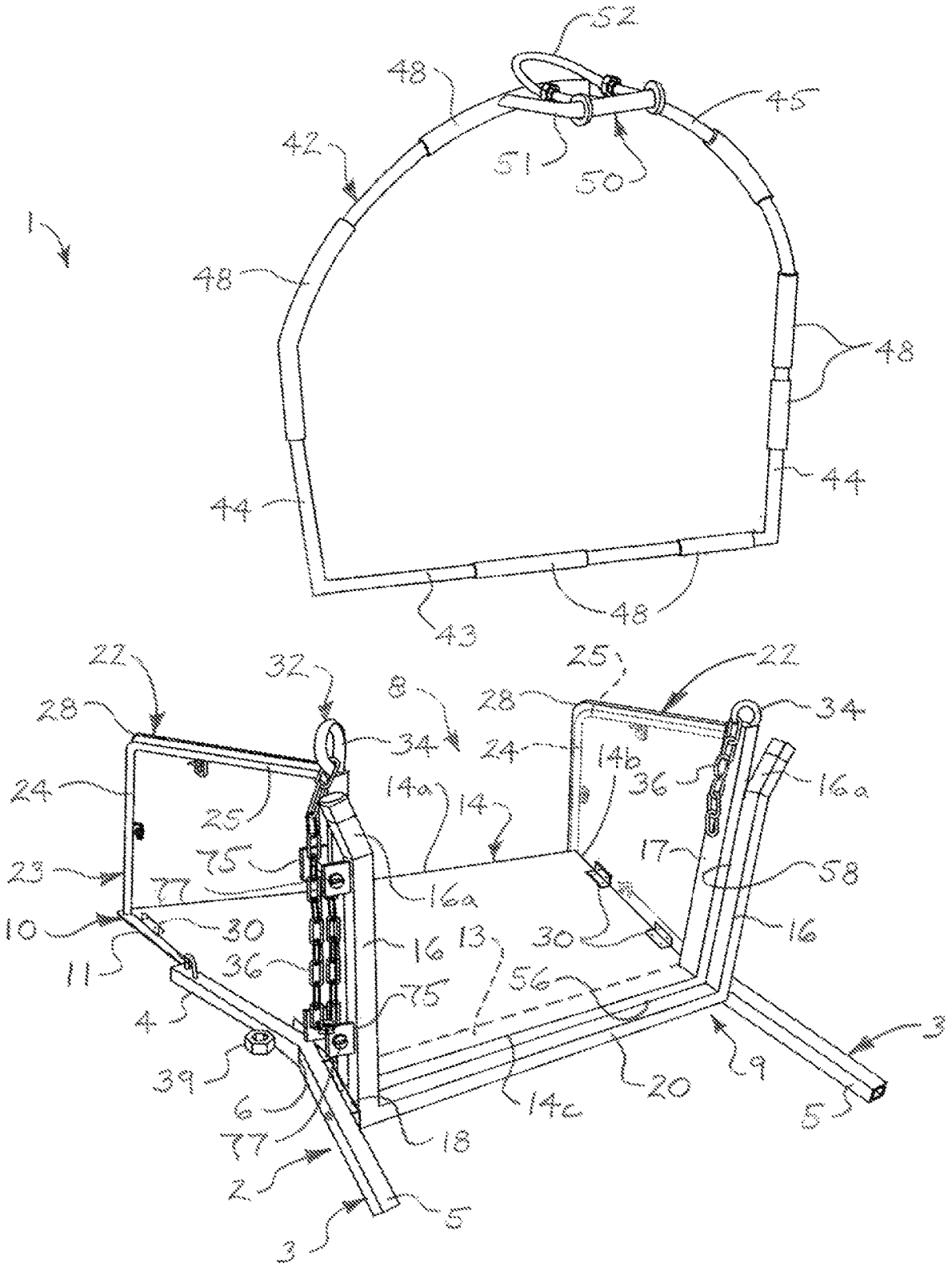
FIG. 5 is an exploded rear perspective view of the illustrative lawn waste bag support device, with the bag ring completely removed from the device frame.
Figure 6:
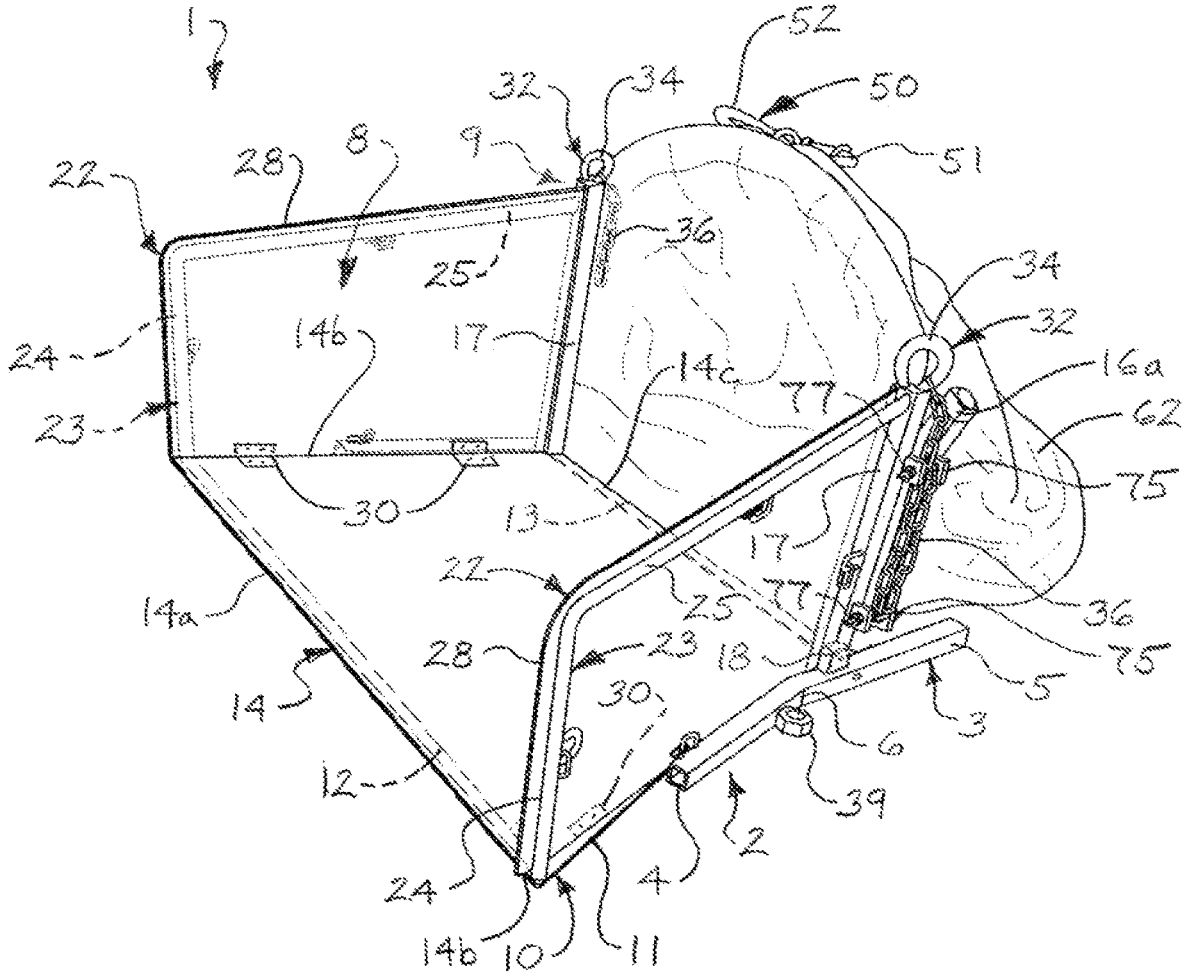
FIG. 6 is a front perspective view of the illustrative lawn waste bag support device with a lawn waste bag deployed in place on the bag ring (not illustrated) and the bag ring deployed in place in the device frame in typical application of the device.
Figure 7:
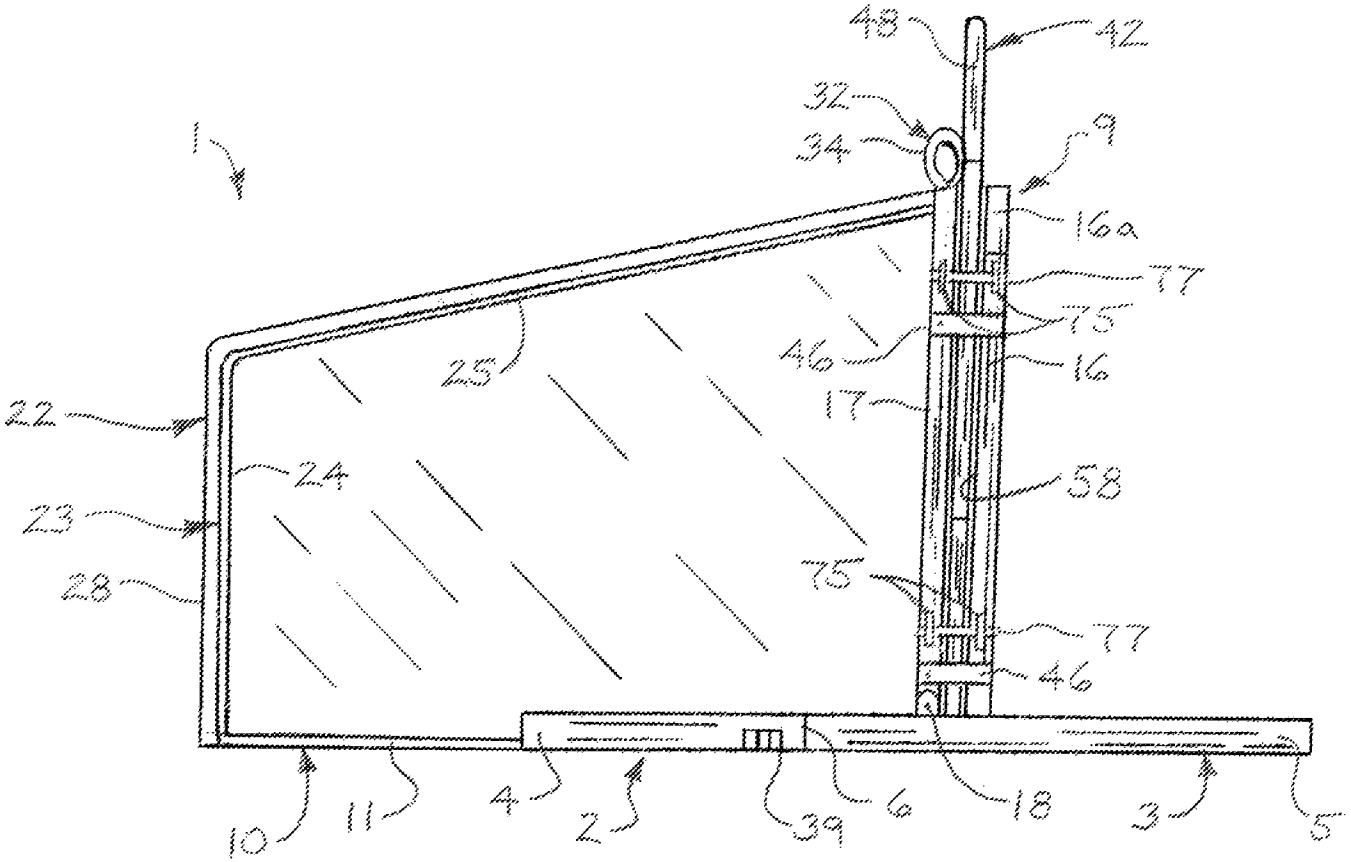
FIG. 7 is a typical left side view of the illustrative lawn waste bag support device with the bag ring deployed in place in the device frame.
Figure 8:
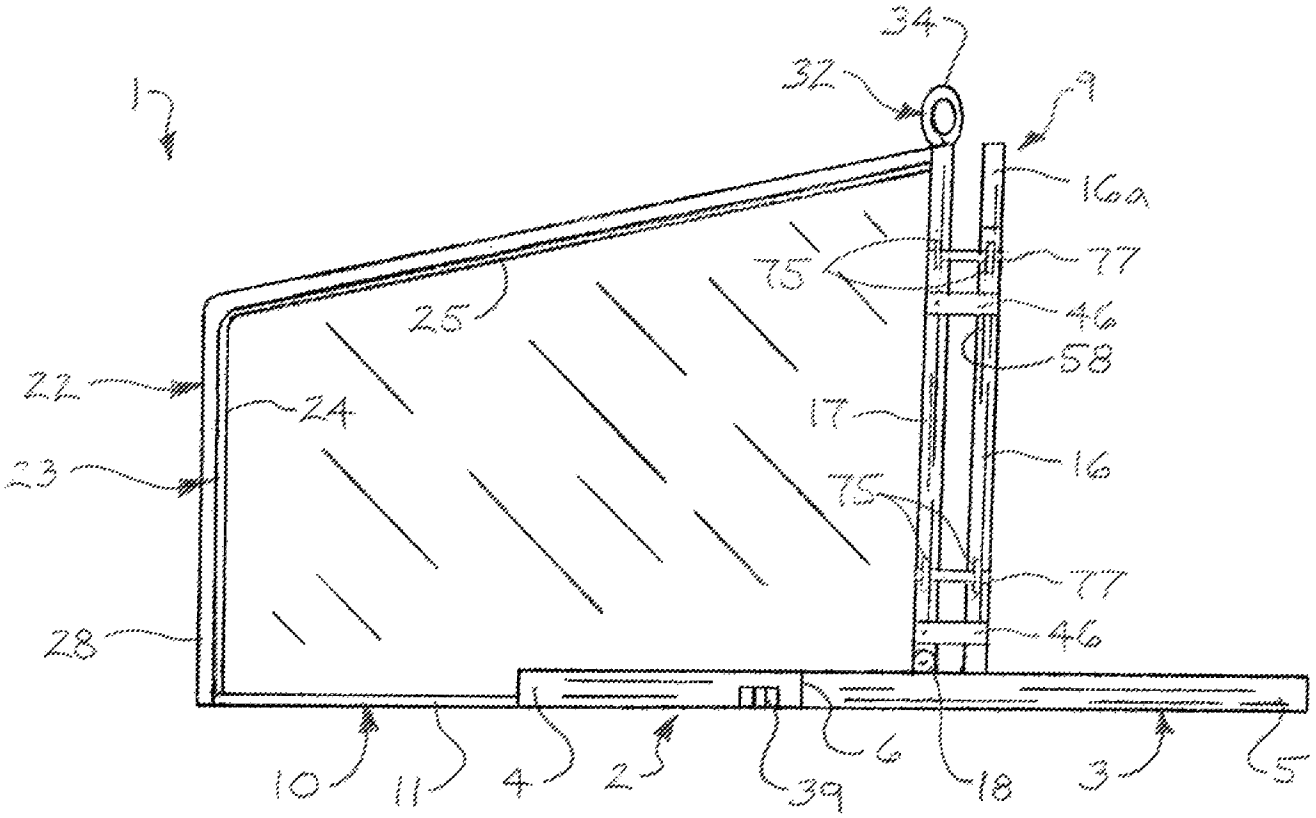
FIG. 8 is a typical left side view of the illustrative lawn waste bag support device with the bag ring removed from the device frame.
Figure 13:
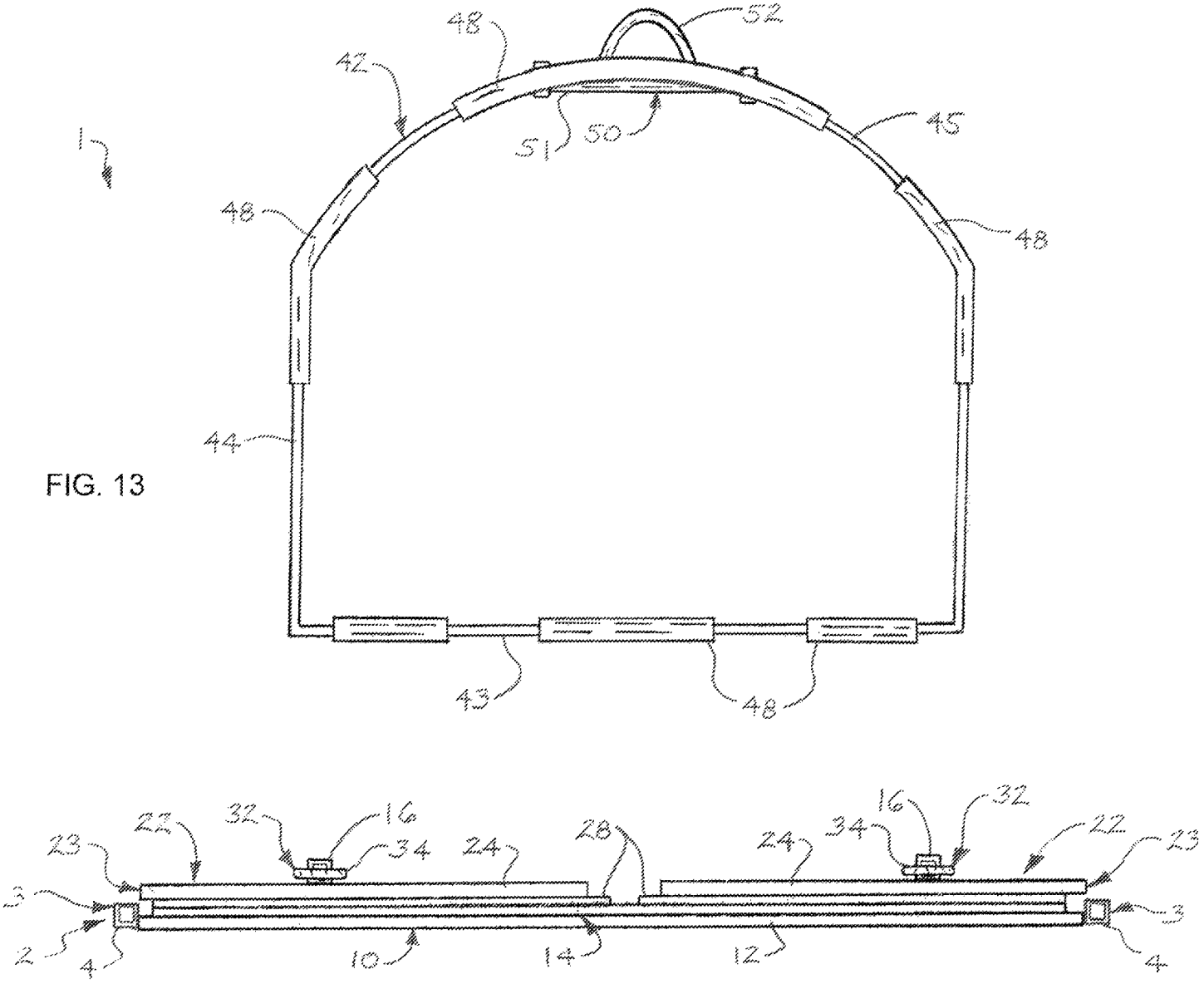
FIG. 13 is an exploded front view of the illustrative lawn waste bag support device in the non-functional configuration with the bag ring detached from the device frame.
Figure 14:
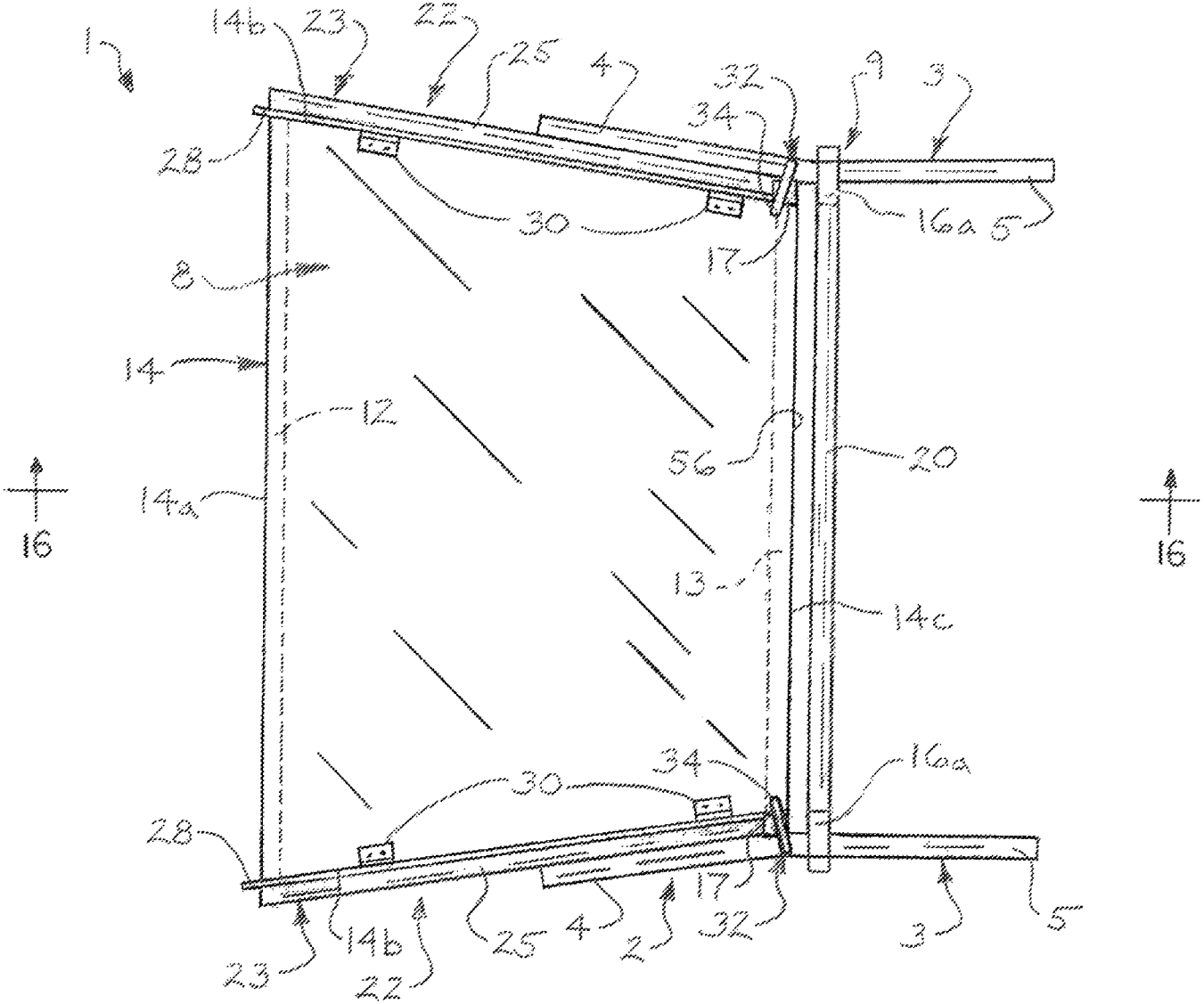
FIG. 14 is a top view of the illustrative lawn waste bag support device deployed in the extended, functional configuration.

The bag ring 42 may have any design which is suitable for the purpose of securing the lawn waste bag 62 (FIG. 17) and enabling insertion of the bag ring 42 with the attached lawn waste bag 62 into the side ring channels 58 and the bottom ring channel 56. As illustrated in FIGS. 5 and 13, in some embodiments, the bag ring 42 may include a bottom ring segment 43. A pair of spaced-apart side ring segments 44 may extend from the bottom ring segment 43. A top ring segment 45 may extend between the side ring segments 44. In some embodiments, the top ring segment 45 may be curved, as illustrated. At least one resilient material such as at least one resilient grip sleeve 48 which may be rubber, plastic and/or other greppable material, for example and without limitation, may be provided on the bottom ring segment 43, the side ring segments 44 and the top ring segment 45 of the bag ring 42 to achieve a snug fit of the bag ring 42 in the bottom ring channel 56 and the side ring channels 58 and facilitate tight engagement of the lawn waste bag 62 between the bag ring 42 and the ring retaining members 16 and respective front ring retaining members 17. In some embodiments, the resilient material may be applied to the bag ring 42 as a continuous layer or coating by dipping, spraying and/or otherwise applying the material to the bag ring 42 according to the knowledge of those skilled in the art.

At least one bag clamp 50 may be provided on the bag ring 42. The bag clamp 50 may have any design which is suitable for the purpose of detachably securing the lawn waste bag 62 to the bag ring 42. In some embodiments, the bag clamp 50 may include a base clamp portion 51 which extends from the bag ring 42. A clasp 52 may be pivotally attached to the base clamp portion 51. The clasp 52 may be suitably sized and configured to pivot into and secure inside the base clamp portion 51 through a friction or interference fit. Accordingly, the lawn waste bag 62 may be secured between the base clamp portion 51 and the clasp 52 to attach the lawn waste bag 62 to the bag ring 42 by extending the edge of the lawn waste bag 62 between the base clamp portion 51 and the clasp 52 and pushing the clasp 52 into the base clamp portion 51. The lawn waste bag 62 may be released from the bag ring 42 by removing the clasp 52 from the base clamp portion 51. Alternative techniques known by those skilled in the art may be used to attach the lawn waste bag 62 to the bag ring 42.

In some embodiments, at least one anchor spike 32 may be attached to the device frame 2. The anchor spike 32 may facilitate anchoring of the lawn waste bag support device 1 to the lawn 80, as illustrated in FIG. 17 and will be hereinafter described. Each anchor spike 32 may include an elongated and pointed or tapered anchor spike shaft 33 (FIG. 17). An anchor spike hook 34 may terminate the anchor spike shaft 33. An anchor tether 36 may attach the anchor spike hook 34 to the device frame 2 at any suitable location or position. For example and without limitation, in some embodiments, the anchor tether 36 may be attached to the adjustment bolt 77 of one of the channel adjusting assemblies 74. Accordingly, the anchor tether 36 may be attached at one end to the adjustment bolt 77 and at the other end to the anchor spike hook 34 of the anchor spike 32 to tether the anchor spike 32 to the device frame 2. In some embodiments, when not in use, each anchor spike 32 may be stowed in each corresponding front ring retaining member 17, as illustrated in FIGS. 1-6.

At least one spike ring 39 may be welded and/or otherwise attached to at least one of the side frame members 3 of the device frame 2. The spike ring 39 may be suitably sized and configured to receive the anchor spike shaft 33 of the anchor spike 32 in anchoring the lawn waste bag support device 1 on the lawn 80, as will be hereinafter described.

Referring next to FIGS. 4-17 of the drawings, in typical application, the lawn waste bag support device 1 may initially be placed flat on the lawn 80 which is to be raked or cleaned of lawn waste 72. The lawn waste support device 1 may then be deployed from the folded or collapsed, non-functional storage and/or transport configuration illustrated in FIGS. 11, 13 and 15 to the extended, functional configuration illustrated in FIGS. 6, 7, 12 and 14. Accordingly, the front ring retaining members 16 may initially be pivoted about the respective retaining member hinges 18 as they are lifted from the respective folded side panel assemblies 22 to their upward-standing positions. The side panel assemblies 22 may then be pivoted about the respective sets of panel hinges 30 from their horizontal folded positions on the base panel 14 to the vertical extended positions along the respective side panel edges 14*c* of the base panel 14. As illustrated in FIGS. 18 and 19, in some embodiments, the adjustment bolts 77 may be extended through the aligned bolt openings 76 in the respective channel adjusting flanges 75 of the channel adjusting assembly 74 and secured. The adjustment bolts 77 may thus secure the respective front ring retaining members 16 and side panel assemblies 22 in the extended, functional configuration during subsequent use of the lawn waste bag support device 1.

The lawn waste bag 62 may be attached to the bag ring 42 by extending the mouth of the lawn waste bag 62 through the bag ring 42 and wrapping the mouth of the bag around the outside of the bag ring 42 and then securing the bag clamp or clamps 50, typically as was heretofore described. The bag ring 42 with the lawn waste bag 62 secured thereon may then be inserted into the side ring channels 58 and the bottom ring channel 56 with the device interior 8 of the lawn waste support device 1 communicating with the interior of the lawn waste bag 62, as illustrated in FIG. 17. The anchor spikes 32 may be removed from the respective front ring retaining members 17, inserted through the respective spike rings 39 and pushed into the lawn 80. Accordingly, the anchor tethers 36 may be stretched taut between the anchor spike hooks 34 on the respective anchor spikes 32 and the adjusting bolts 77 which extend between the channel adjusting flanges 75 of the channel adjusting assembly 74 to secure or anchor and prevent inadvertent movement of the lawn waste bag support device 1 on the lawn 80 during use.

As illustrated in FIG. 17, a user 70 may grasp a rake or other yard implement 71 and rake or push the lawn waste 72 from the lawn 80, onto the base panel 14 and through the device interior 8 into the open mouth of the lawn waste bag 62. The typically inwardly angled side panels 28 of the respective side panel assemblies 22 may funnel the lawn waste 72 into the lawn waste bag 62. After it has been filled with the lawn waste 72, the lawn waste bag 62 may be detached from the lawn waste bag support device 1 by initially lifting and removing the bag ring 42 from the bottom ring channel 56 and the side ring channels 58. The bag clamp or clamps 50 may then be disengaged from the mouth of the lawn waste bag 62, which may be tied and discarded. An empty replacement lawn waste bag 62 may then be secured to the bag ring 42 and reinserted in the bottom ring channel 56 and side ring channels 58 for subsequent filling of the lawn waste bag 62 with additional lawn waste 72 typically in like manner.

Figure 9:
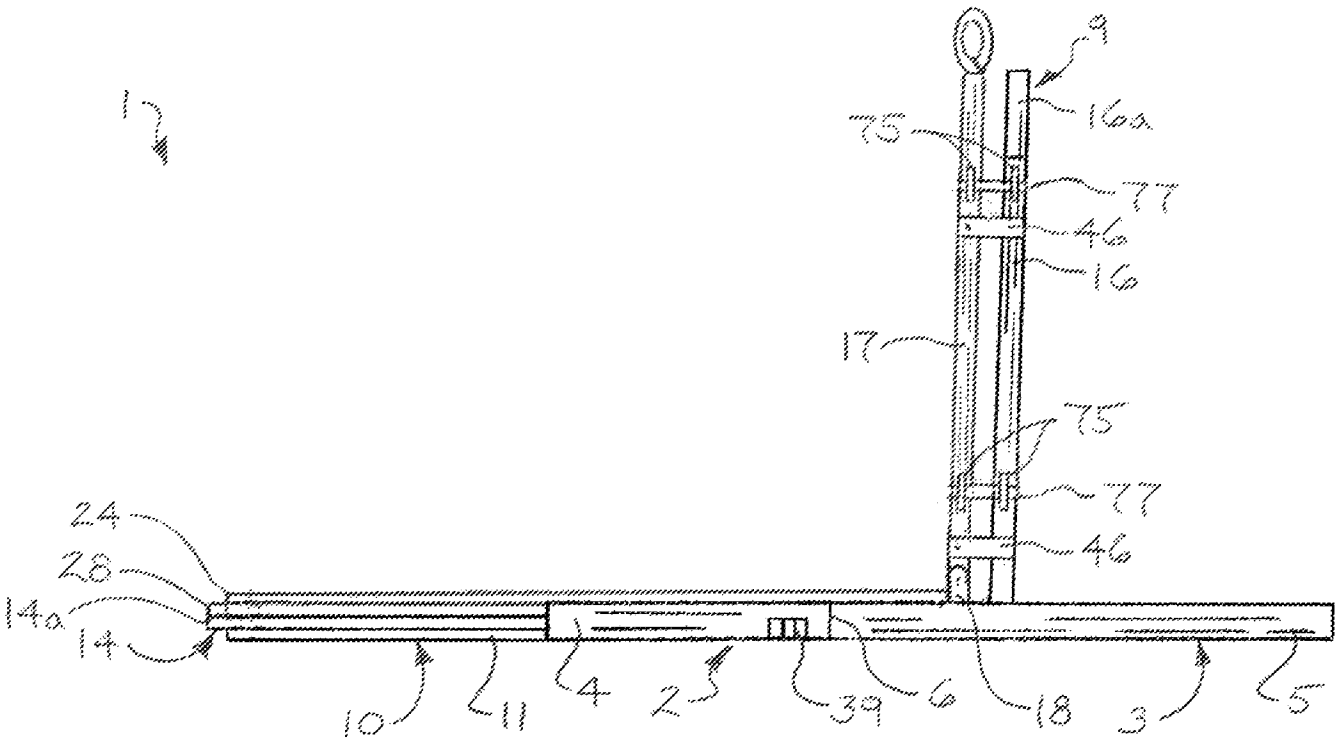
FIG. 9 is a typical left side view of the illustrative lawn waste bag support device with the side panel assemblies (one of which is illustrated) folded to lie on the base panel in deployment of the device from an extended, functional configuration to a folded or collapsed non-functional configuration.
Figure 10:
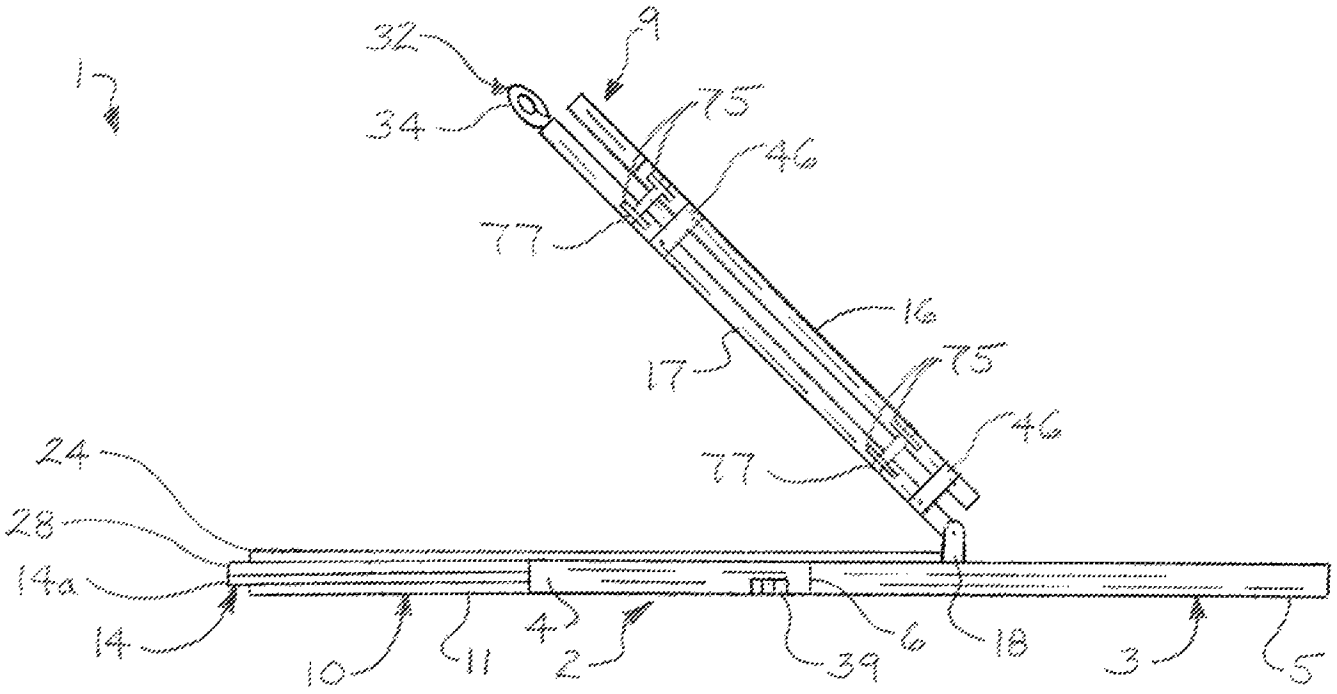
FIG. 10 is a typical left side view of the illustrative lawn waste bag support device, more particularly illustrating pivoting of each ring retaining member (one of which is illustrated) to lie on the respective side panel assemblies in the non-functional configuration.
Figure 11:
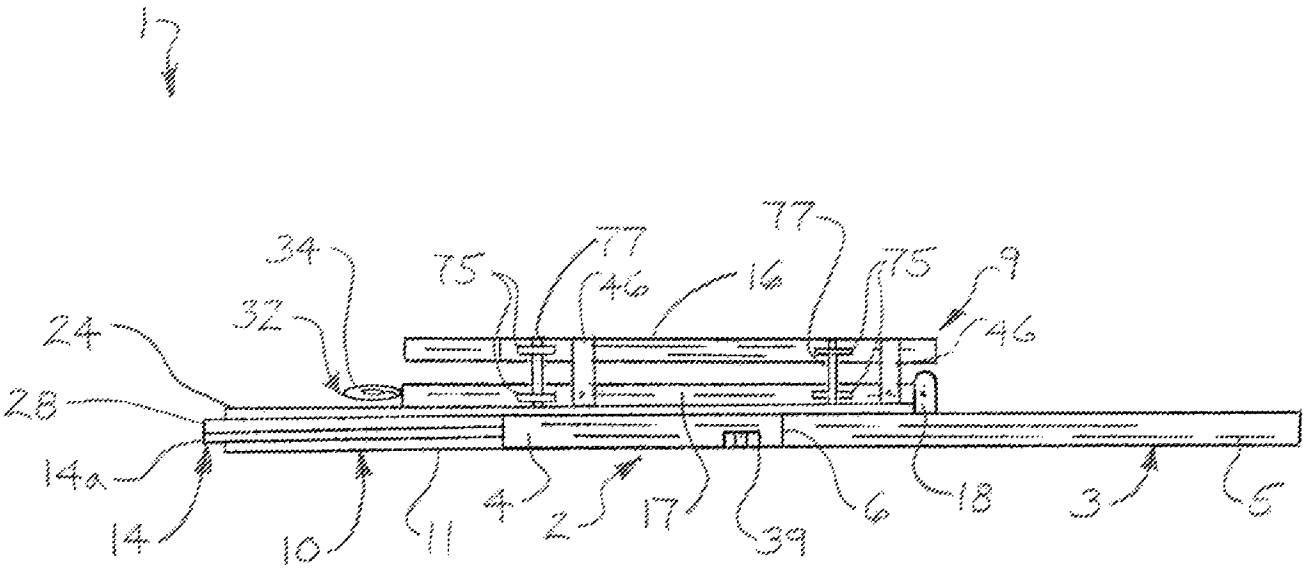
FIG. 11 is a typical left side view of the illustrative lawn waste bag support device with the pivoted ring retaining member lying on the corresponding side panel assembly in the non-functional configuration of the device.
Figure 12:
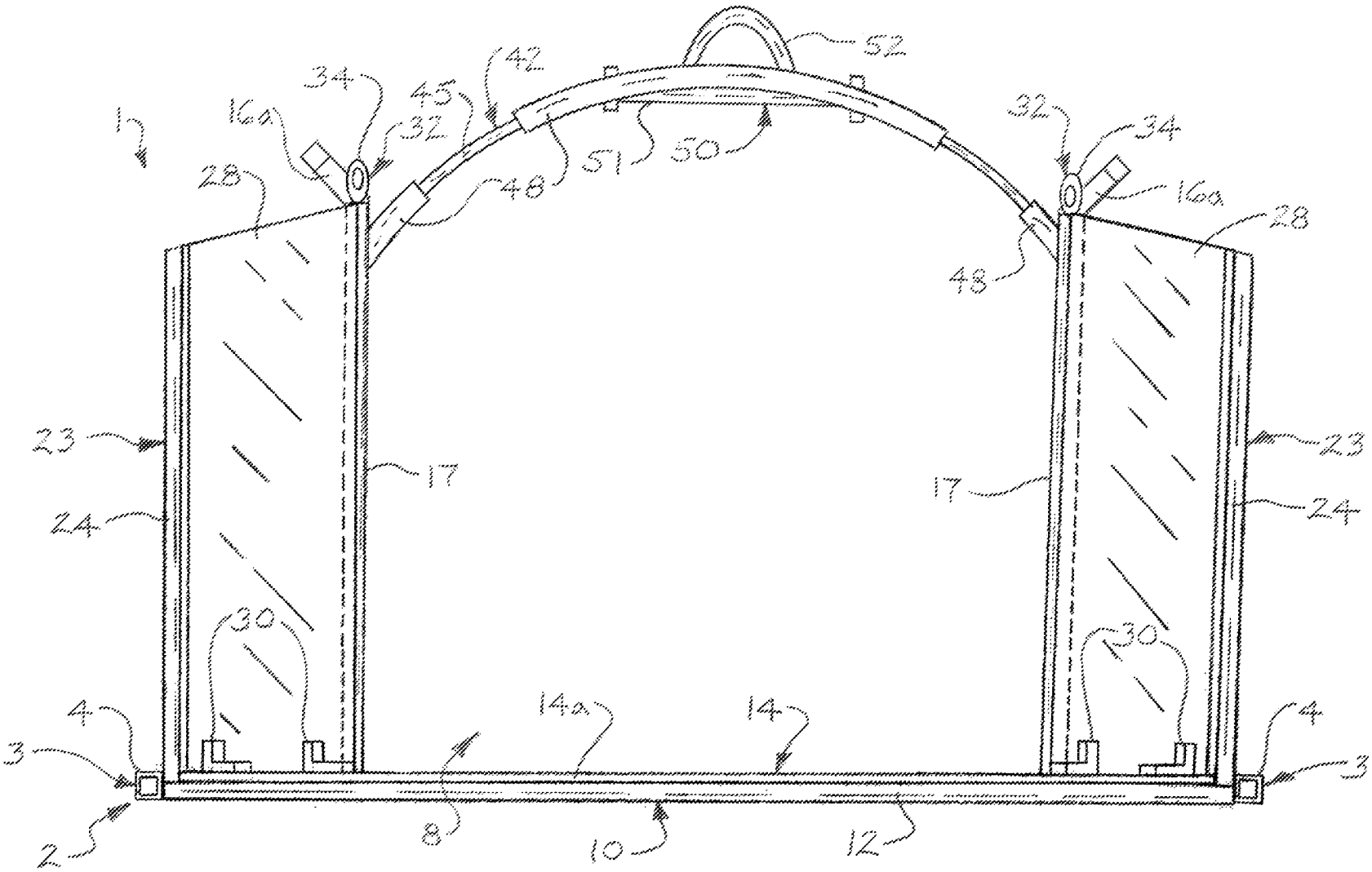
FIG. 12 is a front view of the illustrative lawn waste bag support device deployed in the extended, functional configuration.
Figure 15:
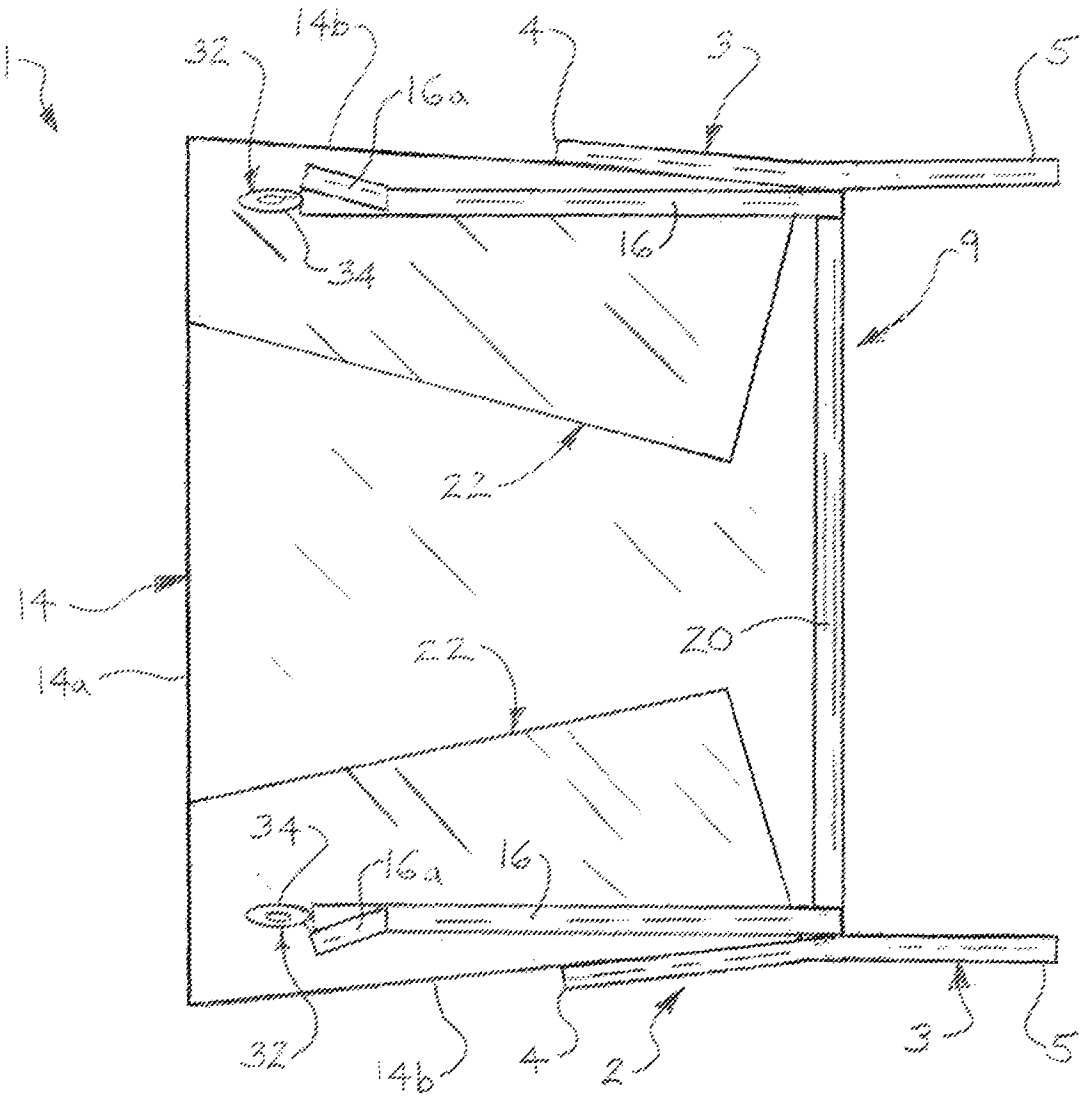
FIG. 15 is a top view of the illustrative lawn waste bag support device with the side panel assemblies folded to lie on the base panel and the ring retaining members pivoted to lie on the respective side panel assemblies in the folded, non-functional configuration of the device.

After use, the lawn waste bag support device 1 may be deployed from the extended, functional configuration back to the collapsed or folded non-functional configuration for space-efficient transport and/or storage. Accordingly, the anchor spikes 32 may initially be pulled from the lawn 80 and removed from the respective spike rings 39 on the side frame members 3 of the device frame 2. The anchor spikes 32 may then be reinserted in the respective front ring retaining members 17. In some embodiments, the adjustment bolts 77 may be unsecured and removed from the bolt openings 76 in the respective channel adjusting flanges 75. The side panel assemblies 22 may be folded with respect to the panel hinges 30 back onto the base panel 14, as illustrated in FIGS. 9 and 15. The front ring retaining members 16 may then be pivoted from the upward-standing vertical position to the horizontal position to rest on the respective folded side panel assemblies 22, as illustrated in FIGS. 9-11.

Referring next to FIGS. 18 and 19 of the drawings, in some embodiments of the lawn waste bag support device 1, the bottom ring channel 56 and the side ring channels 58 may be selectively adjustable in width according to the knowledge of those skilled in the art. Accordingly, the nut 78 may be threaded on the adjustment bolt 77 against one of the channel adjusting flanges 75 to move the rear ring retaining member 16 and the front ring retaining member 17 toward each other to narrow the side ring channel 58. A snug fit of the bag ring 42 in the bottom ring channel 56 and side ring channels 58 may thus be achieved. After use of the lawn waste bag support 1, the bag ring 42 may be removed from the bottom ring channel 56 and side ring channels 58 by loosening the nut 78 on the adjustment bolt 77 such that the rear ring retaining member 16 and front ring retaining member 17 recoil away from each other, widening the bottom ring channel 56 and side ring channels 58 for ease in removal of the bag ring 42. Alternatively, the channel adjusting assemblies 74 may be adjusted once to achieve an optimal fit of the bag ring 42 in the bottom ring channel 56 and side ring channels 58. Accordingly, it will be appreciated by those skilled in the art that the resilient grip sleeves 48 on the bag ring 42 may deform to securely engage the rear ring retaining members 16 and front ring retaining members 17 and achieve a secure fit of the bag ring 42. Moreover, the mouth of the lawn waste bag 62 may be securely engaged between each grip sleeve 48 and the rear ring retaining member 16 or front ring retaining member 17 to additionally secure the lawn waste bag 62 on the bag ring 42 throughout use of the device 1.

Figure 21:
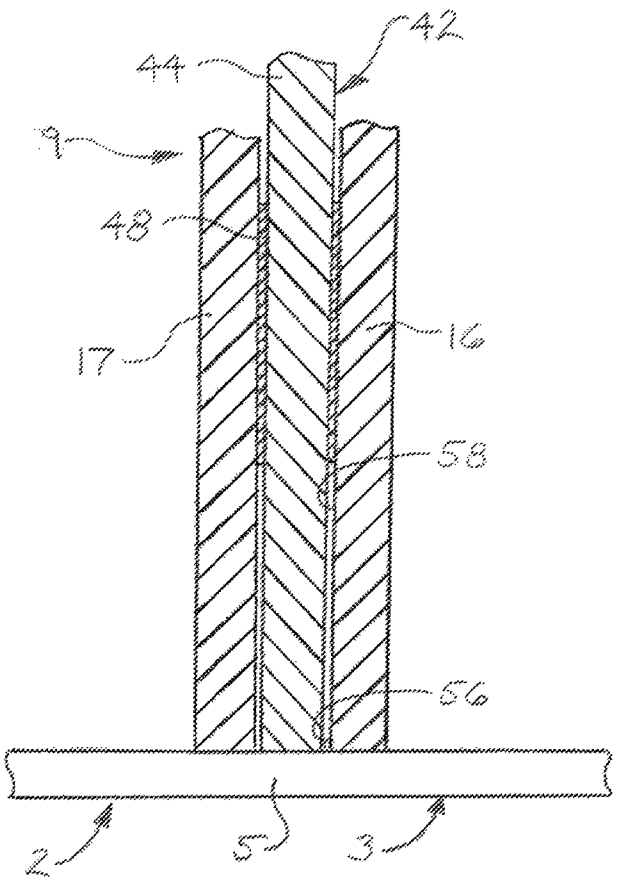
FIG. 21 is a sectional view of the ring retaining member and the rear panel frame segment with the bag ring inserted in the width-adjusted bottom ring channel and side ring channels.
Figure 20:
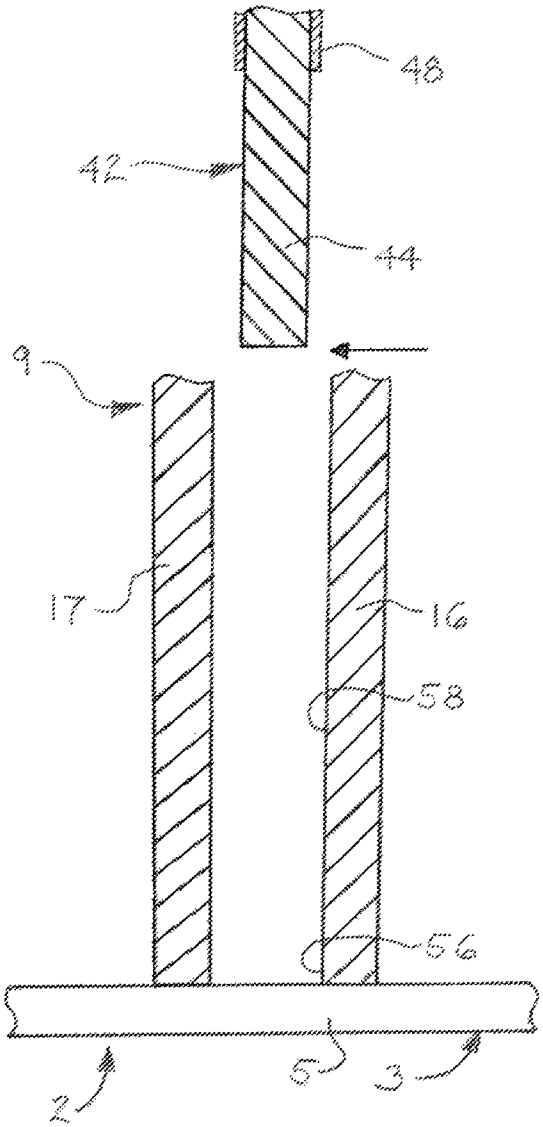
FIG. 20 is a sectional view of a ring retaining member, a rear panel frame segment and a bag ring according to some illustrative embodiments of the lawn waste bag support devices, more particularly illustrating adjustability in the width of the bottom ring channel and side ring channels prior to insertion of the bag ring into the bottom ring channel and side ring channels.

Referring next to FIGS. 20 and 21 of the drawings, in some embodiments, each rear ring retaining member 16 may be adjustably mounted on the corresponding rear frame member segment 5 of the side frame member 3 according to the knowledge of those skilled in the art. Accordingly, as illustrated in FIG. 20, the rear ring retaining member 16 may initially be positionally adjusted to widen the bottom ring channel 56 and side ring channels 58. The bag ring 42 with the lawn waste bag (not illustrated) secured thereto may then be inserted into the side ring channels 58 and bottom ring channel 56, after which the rear ring retaining member 16 may be readjusted to tightly engage and secure the bag ring 42. After use, the bag ring 42 may be subsequently removed from the widened bottom ring channel 56 and side ring channels 58. Prior to first use, the rear ring retaining member 16 may be selectively adjusted to correspondingly adjust the bottom ring channel 56 and the side ring channels 58 to achieve an optimum fit of the bag ring 42 in the bottom ring channel 56 and the side ring channels 58. In some applications, the rear ring channel 56 and side ring channels 58 may be adjusted to accommodate bags of different thicknesses and materials.

Figure 23:
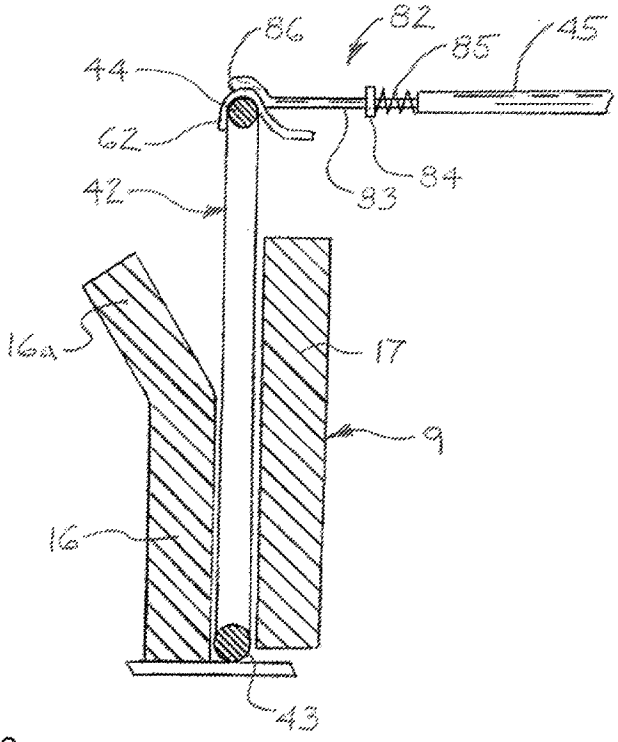
FIG. 23 is a front view of the bag securing assembly illustrated in FIG. 22, deployed in a securing configuration.
Figure 22:
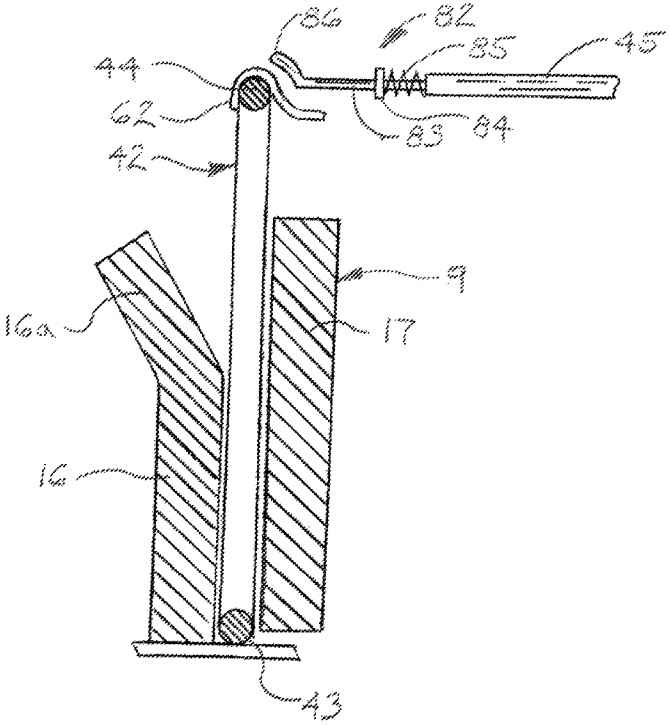
FIG. 22 is a front view of a typical bag securing assembly provided on the bag ring according to some illustrative embodiments of the lawn waste bag support devices, deployed in a released configuration.

Referring next to FIGS. 22 and 23 of the drawings, in some embodiments, at least one bag clamp 82 on the bag ring 42 may include a clamp arm 83 which may be telescopically extendable from the top ring segment 45. A curved arm flange 86 may terminate the clamp arm 83. An arm tab 84 may be provided on the clamp arm 83 in spaced-apart relationship to the top ring segment 45. An arm spring 85 may be sandwiched between the top ring segment 45 and the arm tab 84. Accordingly, the arm spring 85 may normally bias the clamp arm 83 in an extended position relative to the top ring segment 45 such that the arm flange 86 normally engages the side ring segment 44 of the bag ring 42.

In typical attachment of the lawn waste bag 62 to the bag ring 42, the clamp arm 83 may be pushed into the top ring segment 45 against the bias imparted by the arm spring 85 against the arm tab 84 such that the arm flange 86 disengages the side ring segment 44. The mouth of the lawn waste bag 62 may be extended around the bag ring 42, after which the clamp arm 83 may be released such that the arm spring 85 urges the arm flange 86 against the lawn waste bag 62 to secure the lawn waste bag 62 on the bag ring 42. The bag ring 42 with the lawn waste bag 62 attached thereto may then be inserted into the bottom ring channel 56 and side ring channels 58 for use of the lawn waste bag support device 1, typically as was heretofore described. After use, the clamp arm 83 may be pushed into the top ring segment 45 against the bias imparted by the arm spring 85 such that the arm flange 86 disengages the lawn waste bag 62. The released lawn waste bag 62 can then be removed from the bag ring 42, tied and discarded.

Figure 24:
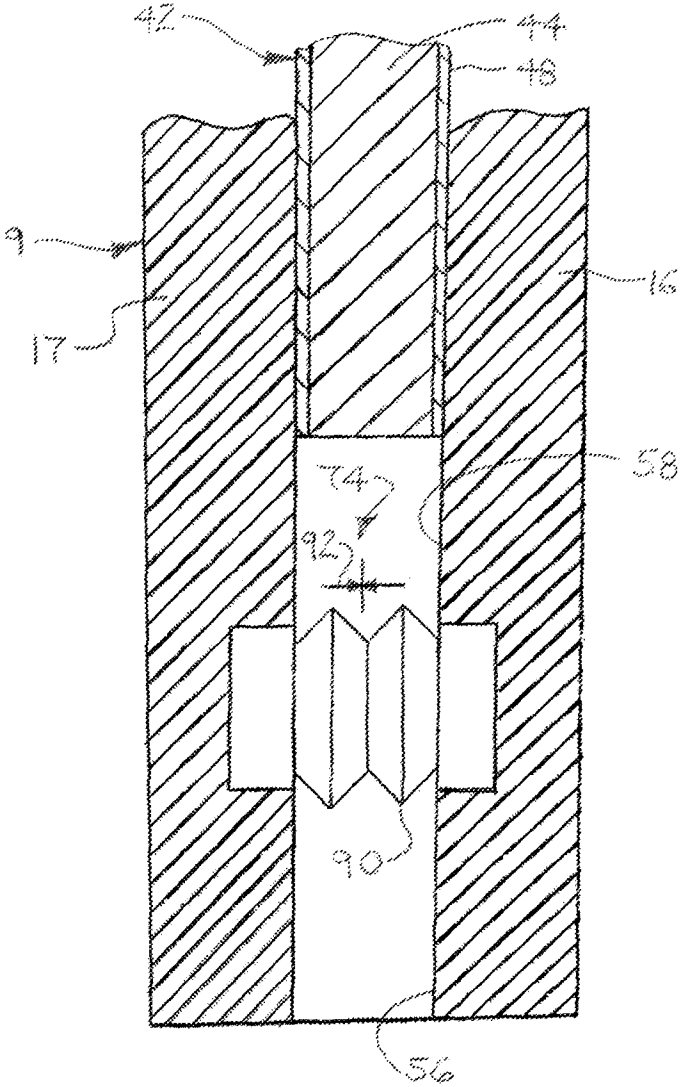
FIG. 24 is a sectional view of the ring retaining member and the rear panel frame segment with a channel adjusting assembly having an expandable spring spanning the ring retaining member and the rear panel frame segment to adjust the width of the bottom ring channel and side ring channels and the bag ring partially inserted in the side ring channels.

Referring next to FIG. 24 of the drawings, in some embodiments, the channel adjusting assembly 74 may include at least one expandable spring 90 which extends between and engages the front ring retaining member 17 and the corresponding rear ring retaining member 16. The expandable spring 90 may be fabricated of metal, plastic, nylon and/or other materials. The expandable spring 90 may apply an inward force 92 against the front ring retaining member 17 and the rear ring retaining member 16 to normally narrow the bottom ring channel 56 and the side ring channels 58. Accordingly, the inward force 92 applied by the expandable spring 90 may facilitate tight engagement of the interior surfaces of the front ring retaining member 17 and the rear ring retaining member 16 against the bag ring 42 to achieve a secure fit of the bag ring 42 in the bottom ring channel 56 and side ring channels 58.

Figure 25:
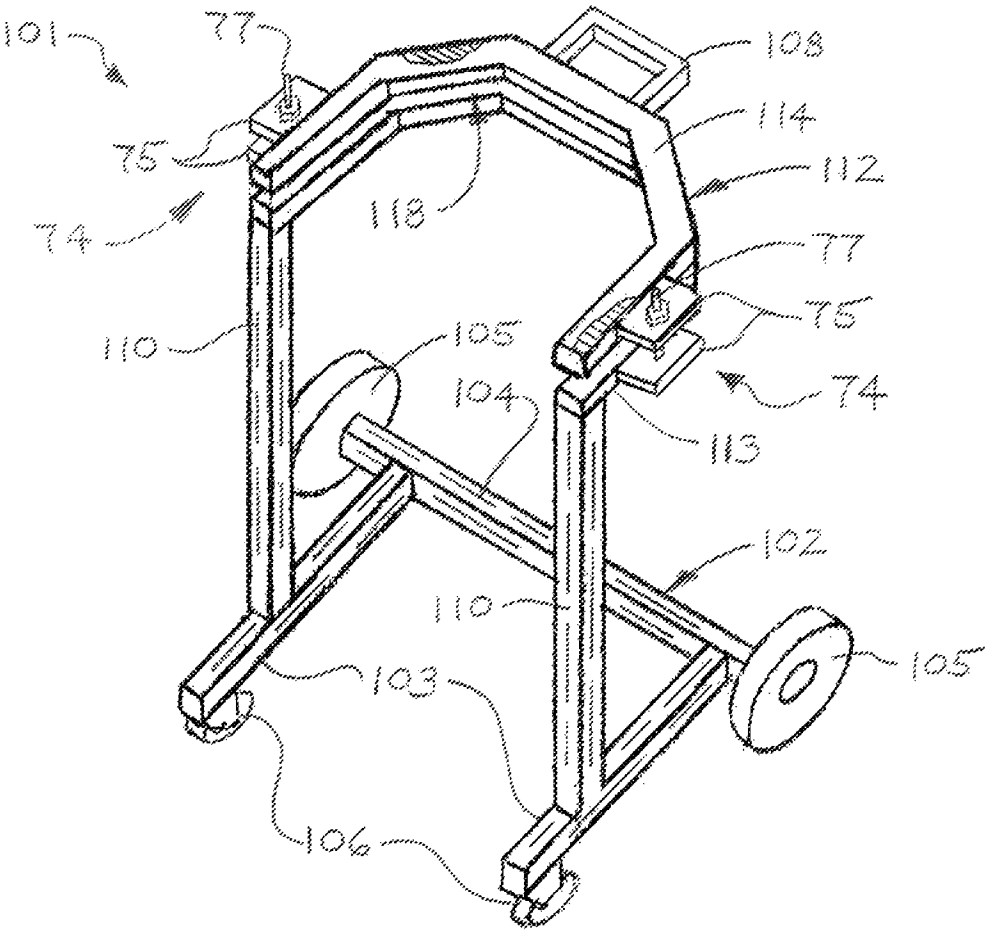
FIG. 25 is a front perspective view of an illustrative bag cart embodiment of the lawn waste bag support devices.
Figure 26:
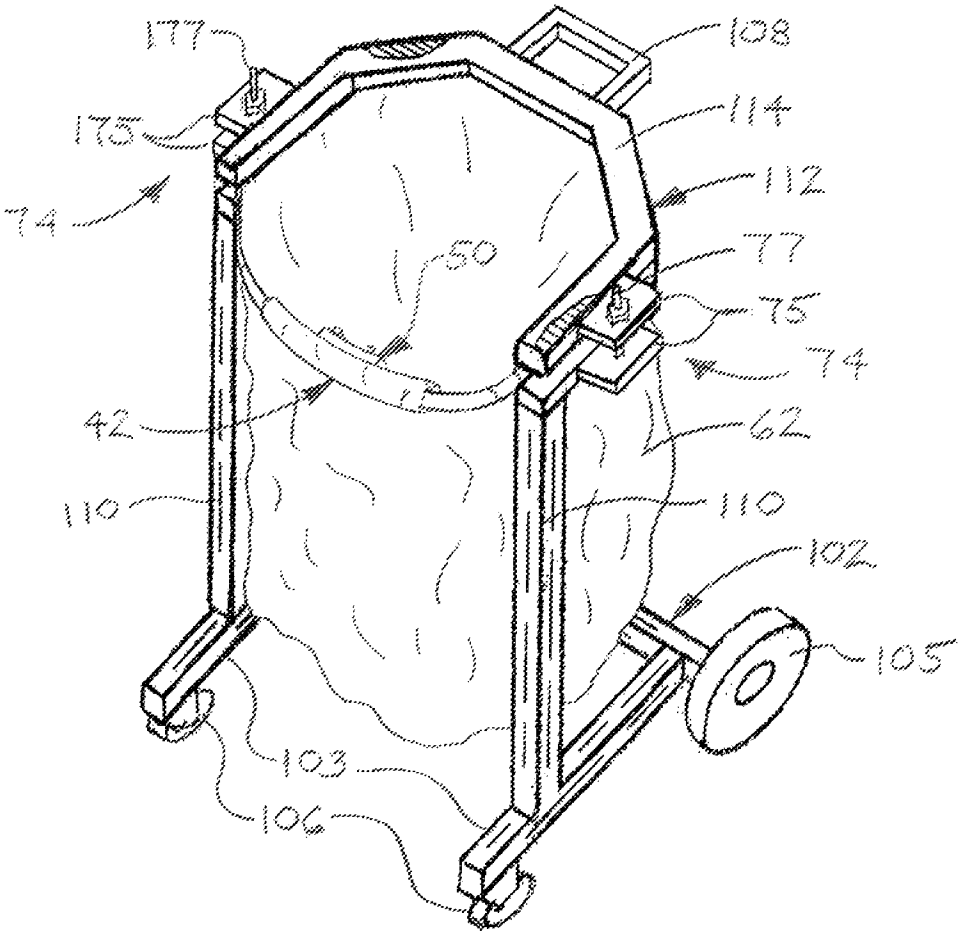
FIG. 26 is a front perspective view of the illustrative bag cart embodiment of the lawn waste bag support devices illustrated in FIG. 25, with the bag ring inserted in the bag ring support frame and a lawn waste bag supported on the bag ring in typical application of the device.

Referring next to FIGS. 25 and 26 of the drawings, an illustrative bag cart embodiment of the lawn waste bag support devices is generally indicated by reference numeral 101. The bag cart 101 may include a device frame 102 which may be in the form of a wheeled cart frame. The device frame 102 may include a pair of elongated, parallel, spaced-apart side frame members 103. An axle frame member 104 may extend between the side frame members 103. A pair of cart wheels 105 may be provided on the axle frame member 104. Caster wheels 106 may be provided on the front ends of the respective side frame members 103.

A pair of elongated, parallel, spaced-apart vertical frame members 110 may extend upwardly from the respective side frame members 103. A bag ring support frame 112 may be supported by the vertical frame members 110. The bag ring support frame 112 may have any design which is suitable for holding and securing the bag ring 42 which holds the lawn waste bag 62. Accordingly, in some embodiments, the bag ring support frame 112 may include a bottom frame member 113. The bottom frame member 113 may be welded and/or otherwise attached to the vertical frame members 110 according to the knowledge of those skilled in the art. A top frame member 114 may be disposed in parallel, spaced-apart relationship to the bottom frame member 113. A ring channel 118 may be formed by and between the bottom frame member 113 and the top frame member 114. The ring channel 118 may be sized and configured to removably receive the bag ring 42. A handle 108 may extend from the bag ring support frame 112.

At least one channel adjusting assembly 74 may be provided on the bag ring support frame 112 to facilitate selective adjustment in the width of the ring channel 118. In some embodiments, each channel adjusting assembly 74 may be the same as or similar in design to that heretofore described with respect to FIGS. 18 and 19 and may include at least one pair of spaced-apart, parallel channel adjusting flanges 75 which extend from the respective bottom frame member 113 and top frame member 114. At least one channel adjustment bolt 77, typically fitted with a securing nut 78 and a pair of jam nuts 79 (FIGS. 18 and 19), may extend through registering bolt openings (not illustrated) in the respective channel adjusting flanges 75. In some embodiments, the channel adjusting assembly 74 include the expandable spring 90, as was heretofore described with respect to FIG. 24. In still other embodiments, each channel adjusting assembly 74 may have alternative designs suitable for the purpose.

As illustrated in FIG. 26, in typical application of the bag cart 101, a lawn waste bag 62 may be secured to the bag ring 42, typically as was heretofore described with respect to FIG. 17. The bag ring 42 with the lawn waste bag 62 secured thereto may then be inserted in the ring channel 118 (FIG. 15) between the bottom frame member 113 and the top frame member 114 of the bag ring support frame 112. The channel adjusting assembly or assemblies 74 may be adjusted, as needed, to adjust the width of the ring channel 118 and achieve the optimum fit of the bag ring 42 in the ring channel 118. Lawn waste and/or other trash (not illustrated) may be placed in the lawn waste bag 62. It will be appreciated by those skilled in the art that the bag ring 42 maintains the lawn waste bag 62 in an open position to facilitate ease in placement of the lawn waste and/or other trash into the lawn waste bag 62. After the lawn waste bag 62 has been filled, the bag ring 42 may be removed from the bag ring support frame 112. The lawn waste bag 62 may be detached from the bag ring 42 and discarded. The bag cart 101 may be transported, as necessary, by pulling or pushing the bag cart 101 by the handle 108 as it rolls on the cart wheels 105 and caster wheels 106.

Figure 27:
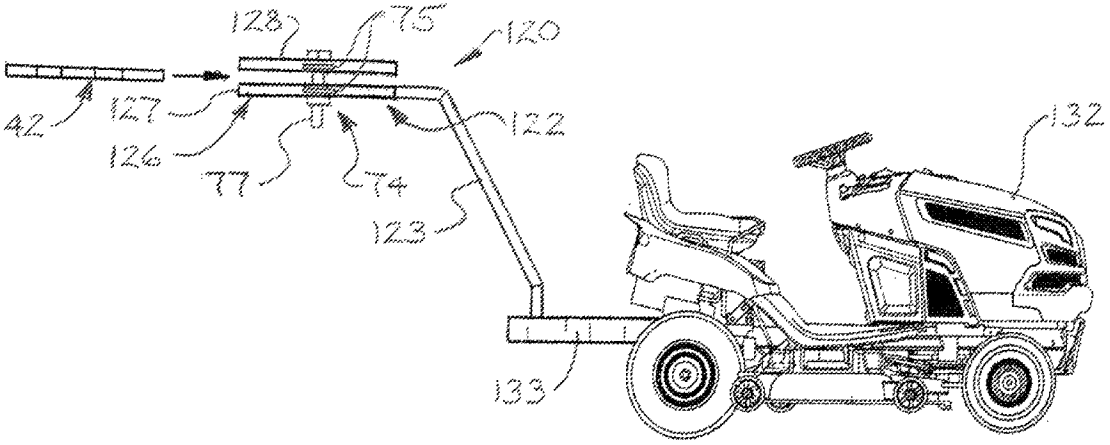
FIG. 27 is a side view of an illustrative bag stand embodiment of the lawn waste bag support devices, supported on a platform attached to a riding lawnmower.
Figure 28:
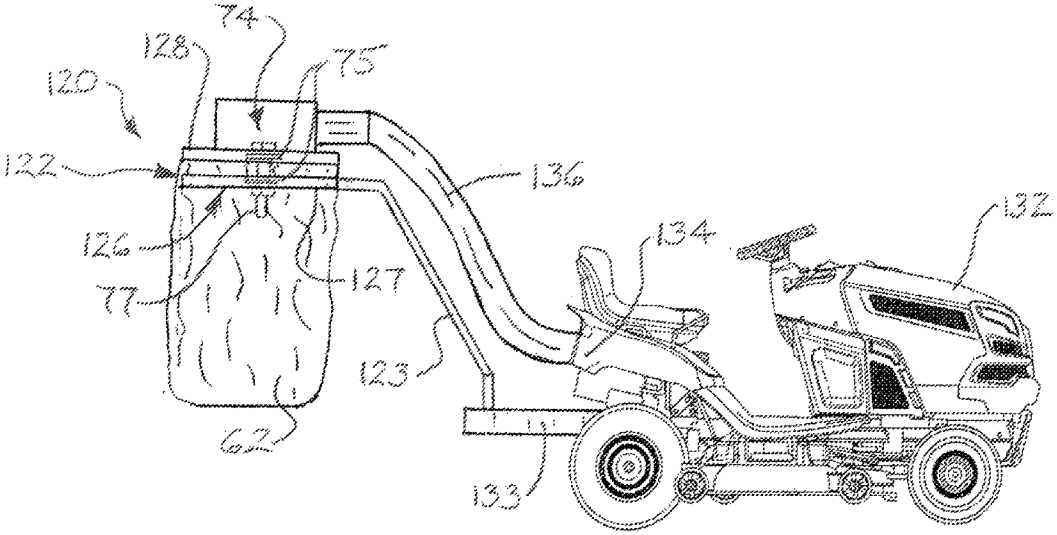
FIG. 28 is a side view of the illustrative bag stand embodiment of the lawn waste bag support devices illustrated in FIG. 27, with the bag ring inserted in the bag ring support frame, a lawn waste bag supported on the bag ring and a lawn waste conduit connecting the riding lawnmower to the lawn waste bag.

Referring next to FIGS. 27 and 28 of the drawings, an illustrative bag stand embodiment of the lawn waste bag support devices, supported on a platform 133 attached to a riding lawnmower 132, is generally indicated by reference numeral 120. The bag stand 120 may include a device frame 122 having a bag stand support arm 123 which may extend rearwardly from the platform 133. The bag ring support frame 126 may include a bottom frame member 127 which may be welded and/or otherwise attached to the bag stand support arm 123 according to the knowledge of those skilled in the art. A top frame member 128 may be disposed in parallel, spaced-apart relationship to the bottom frame member 127. At least one channel adjusting assembly 74 may connect the top frame member 128 to the bottom frame member 127. A ring channel 130 may be formed by and between the bottom frame member 127 and the top frame member 128.

As illustrated in FIG. 28, in typical application of the bag stand 122, a lawn waste bag 62 may be secured to the bag ring 42, typically as was heretofore described with respect to FIG. 17. As illustrated in FIG. 27, the bag ring 42 (with the lawn waste bag 62 secured thereto) may then be inserted in the ring channel 130 (FIG. 27) between the bottom frame member 127 and the top frame member 128 of the bag ring support frame 126. A lawn waste conduit 136 may be placed in communication with the outlet 134 of the riding lawnmower 132 and the lawn waste bag 62 according to the knowledge of those skilled in the art. Accordingly, during operation of the riding lawnmower 132, lawn waste and/or other trash (not illustrated) may be ejected from the outlet 134 through the lawn waste conduit 136 and into the lawn waste bag 62. It will be appreciated by those skilled in the art that the ring bag 42 maintains the lawn waste bag 62 in an open position to facilitate ease in placement of the lawn waste and/or other trash from the lawn waste conduit 136 into the lawn waste bag 62. After the lawn waste bag 62 has been filled, the bag ring 42 may be removed from the bag ring support frame 126. The lawn waste bag 62 may be detached from the bag ring 42 and discarded.

While certain illustrative embodiments of the disclosure have been described above, it will be recognized and understood that various modifications can be made to the embodiments and the appended claims are intended to cover all such modifications which may fall within the spirit and scope of the disclosure.

What is claimed is:

1. A lawn waste bag support device for holding a lawn waste bag in an open position, comprising:

a device frame;

a base panel carried by the device frame, the base panel having a pair of side edges;

a pair of upright spaced-apart panel assemblies deployed along the pair of side panel edges, respectively, of the base panel;

an upright bag ring support frame carried by the device frame, the bag ring support frame having a pair of spaced-apart side ring channels formed by and between the device frame and the pair of spaced-apart side panel assemblies, respectively; and a bag ring configured to receive and hold the lawn waste bag in an open position, the bag ring removably deployable in the pair of spaced-apart side ring channels.

2. The lawn waste bag support device of claim 1 further comprising at least one channel adjusting assembly on the bag ring support frame, the at least one channel adjusting assembly configured to selectively adjust the pair of spaced-apart side channel assemblies, respectively, in width.

3. The lawn waste bag support device of claim 1 further comprising at least one grip sleeve on the bag ring, the at least one grip sleeve configured to engage the bag ring support frame and secure the bag ring in the pair of spaced-apart side channel assemblies, respectively.

4. The lawn waste bag support device of claim 1 further comprising at least one bag clamp carried by the bag ring, the at least one bag clamp configured to engage and secure the lawn waste bag on the bag ring.

5. The lawn waste bag support device of claim 1 further comprising a a bottom ring channel formed by and between the device frame and the base panel.

6. The lawn waste bag support device of claim 1 wherein the device frame comprises a pair of elongated, spaced-apart side frame members and a base frame portion extending from the side frame members, and the base panel and the side panel assemblies are carried by the base frame portion.

7. The lawn waste beg support device of claim 6 wherein the base panel has a sloped configuration.

8. A lawn waste bag support device for holding a lawn waste bag in an open position, comprising:

a device frame;

an upright bag ring support frame carried by the device frame, the bag ring support frame having at least one ring channel;

a bag ring configured to receive and hold the lawn waste bag in an open position, the bag ring removably deployable in the at least one ring channel;

a base panel carried by the device frame;

a pair of upright spaced-apart panel assemblies carried by the base panel;

wherein the device frame comprises a pair of elongated, spaced-apart side frame members and a base frame portion extending from the side frame members, and the base panel and the side panel assemblies are carried by the base frame portion; and wherein the bag ring support frame comprises a pair of spaced-apart front ring retaining members carried by the device frame and a pair of spaced-apart rear ring retaining members carried by the device frame in spaced-apart relationship with respect to the front ring retaining members, respectively, and the at least one ring channel comprises a pair of side ring channels between the front ring retaining members and the rear ring retaining members, respectively.

9. A lawn waste bag support device, comprising:

a device frame including:

a pair of elongated, spaced-apart side frame members; and a base frame portion extending from the pair of elongated, spaced-apart side frame members;

an upright bag ring support frame including:

a pair of upright elongated, parallel, spaced-apart front ring retaining members carried by the device frame;

a pair of elongated, parallel, spaced-apart rear ring retaining members carried by the device frame in parallel, spaced-apart relationship to the pair of elongated, parallel, spaced-apart front ring retaining members, respectively;

a cross member extending between the pair of elongated, parallel, spaced-apart rear ring retaining members;

a pair of spaced-apart side ring channels formed by and between the pair of elongated, parallel, spaced-apart front ring retaining members and the pair of elongated, parallel, spaced-apart rear ring retaining members, respectively; and a bottom ring channel formed by and between the base frame portion of the device frame and the cross member;

a base panel carried by the base frame portion of the device frame;

a pair of spaced-apart side panel assemblies carried by the base panel; and a bag ring removably deployed in the bottom ring channel and the pair of spaced-apart side ring channels.

10. The lawn waste bag support device of claim 9 wherein the pair of spaced-apart side panel assemblies is pivotally carried by the base panel.

11. The lawn waste bag support device of claim 9 wherein the pair of elongated, parallel, spaced-apart front ring retaining members is pivotally carried by the pair of elongated, spaced-apart side frame members, respectively, of the device frame.

12. The lawn waste bag support device of claim 9 further comprising at least one bag clamp on the bag ring.

13. The lawn waste bag support device of claim 9 further comprising at least one channel adjustment assembly carried by each of the pair of elongated, parallel, spaced-apart rear ring retaining members and each corresponding one of the pair of elongated, parallel, spaced-apart front ring retaining members, the at least one channel adjustment assembly configured to adjust at least one of the bottom ring channel and the pair of spaced-apart side ring channels in width.

14. The lawn waste bag support device of claim 9 wherein the bag ring comprises a bottom ring segment, a pair of spaced-apart side ring segments extending from the bottom ring segment and a curved top ring segment extending between the pair of spaced-apart side ring segments.

15. The lawn waste bag support device of claim 14 further comprising a resilient material on the bottom ring segment, the pair of spaced-apart side ring segments and the top ring segment of the bag ring.

16. The lawn waste bag support device of claim 9 further comprising at least one anchor spike removably carried by the device frame and at least one anchor tether attaching the at least one anchor spike to the device frame.

17. A lawn waste bag support device, comprising:

a device frame including:

a pair of elongated, spaced-apart side frame members; and a base frame portion extending from the pair of elongated, spaced-apart side frame members, the base frame portion including:

a pair of spaced-apart side base members;

a front base member extending between the pair of spaced-apart side base members; and a rear base member extending between the pair of spaced-apart side base members in parallel, spaced-apart relationship to the front base member;

an upright bag ring support frame including:

a pair of upright elongated, parallel, spaced-apart front ring retaining members pivotally carried by the pair of elongated, spaced-apart side frame members, respectively, of the device frame;

a pair of upright elongated, parallel, spaced-apart rear ring retaining members carried by and disposed in parallel, spaced-apart relationship to the pair of elongated, parallel, spaced-apart front ring retaining members, respectively;

a cross member extending between the pair of elongated, parallel, spaced-apart rear ring retaining members;

a pair of spaced-apart side ring channels formed by and between the pair of elongated, parallel, spaced-apart front ring retaining members and the pair of elongated, parallel, spaced-apart rear ring retaining members, respectively; and a bottom ring channel formed by and between the cross member and the rear base member of the base frame portion of the device frame;

a base panel carried by the base frame portion of the device frame, the base panel having a wide panel edge at the front base member, a narrow panel edge spaced-apart and parallel to the wide panel edge at the rear base member and a pair of side panel edges at the pair of spaced-apart side base members, respectively, and extending inwardly toward each other from the wide panel edge to the narrow panel edge;

a pair of spaced-apart side panel assemblies including a pair of side panels pivotally carried by the base panel at the pair of side panel edges, respectively; and a beg ring removably deployed in the bottom ring channel and the pair of spaced-apart side ring channels.

18. The lawn waste bag support device of claim 17 further comprising at least one bag clamp on the bag ring.

19. The lawn waste bag support device of claim 17 further comprising at least one anchor spike removably carried by the device frame and at least one anchor tether attaching the at least one anchor spike to the device frame.

20. The lawn waste bag support device of claim 17 further comprising at least one channel adjustment assembly on each of the pair of elongated, parallel, spaced-apart rear ring retaining members and each corresponding one of the pair of elongated, parallel, spaced-apart front ring retaining members, the at least one channel adjustment assembly configured to adjust at least one of the bottom ring channel and the pair of spaced-apart side ring channels in width.

* * * * *